US005950955A

United States Patent [19]

Favalli

[11] Patent Number: 5,950,955

[45] Date of Patent: Sep. 14, 1999

[54] TENSIONING UNIT WITH AUTOMATIC TENSION CONTROL FOR YARN-FORMED FABRICS

[75] Inventor: Giovanni Favalli, Brescia, Italy

[73] Assignee: Orizio Paolo S.p.A., Italy

[21] Appl. No.: 09/019,820

[22] Filed: Feb. 6, 1998

[30] Foreign Application Priority Data

Apr. 24, 1997 [IT] Italy ..... MI97A0962

[51] Int. Cl.[6] ..... B65H 23/18

[52] U.S. Cl. ..... 242/413.5; 242/541.1; 242/413.1

[58] Field of Search ..... 242/413, 413.1, 242/413.4, 413.5, 414, 414.1, 541.1

[56] References Cited

U.S. PATENT DOCUMENTS

| | | | |
|---|---|---|---|
| 2,325,381 | 7/1943 | Edwards et al. | 242/413.1 |
| 3,730,450 | 5/1973 | Hank . | |
| 4,496,112 | 1/1985 | Olsson et al. | 242/413.1 |
| 4,826,093 | 5/1989 | Van Colen | 242/413 |
| 5,312,059 | 5/1994 | Membrino | 242/541.1 |

FOREIGN PATENT DOCUMENTS

| | | | |
|---|---|---|---|
| 728505 | 8/1969 | Belgium . | |
| 1918903 | 11/1970 | Germany . | |
| 22 25 614 | 12/1973 | Germany | 242/413.1 |
| 59-225816 | 12/1984 | Japan | 242/413.1 |
| 2-123078 | 5/1990 | Japan | 242/413.1 |
| 510424 | 4/1976 | U.S.S.R. | 242/413.1 |
| 946726 | 1/1962 | United Kingdom . | |
| 1037727 | 8/1966 | United Kingdom | 242/413.1 |

*Primary Examiner*—John P. Darling
*Attorney, Agent, or Firm*—Hedman, Gibson & Costigan, P.C.

[57] ABSTRACT

A tensioning unit (10) with automatic control of the tension (T) of yarn-formed fabrics (F), having a first electric card (50) mounted in an electromechanical cubicle (60) and used to set the drawing parameters or store and load applicational drawing programs, and a second electronic card (50A), identical to the first and mounted on the tensioning unit (10), and which utilizes a processing program to control an inverter (28), that is connected to a drawing motor (25), in response to a feedback signal originating from a linear position transducer (P) rigid with a spring (30) for tensioning the yarn; a third electronic card (40A) is provided to establish communication between the first electronic card (50) and the second (50A) via a serial line (54) using an infrared optical coupling system. The speed of the motor (25) is controlled on the basis of information received to the position of the spring (30), in such a manner as to maintain the yarn tension (T) constant.

11 Claims, 41 Drawing Sheets

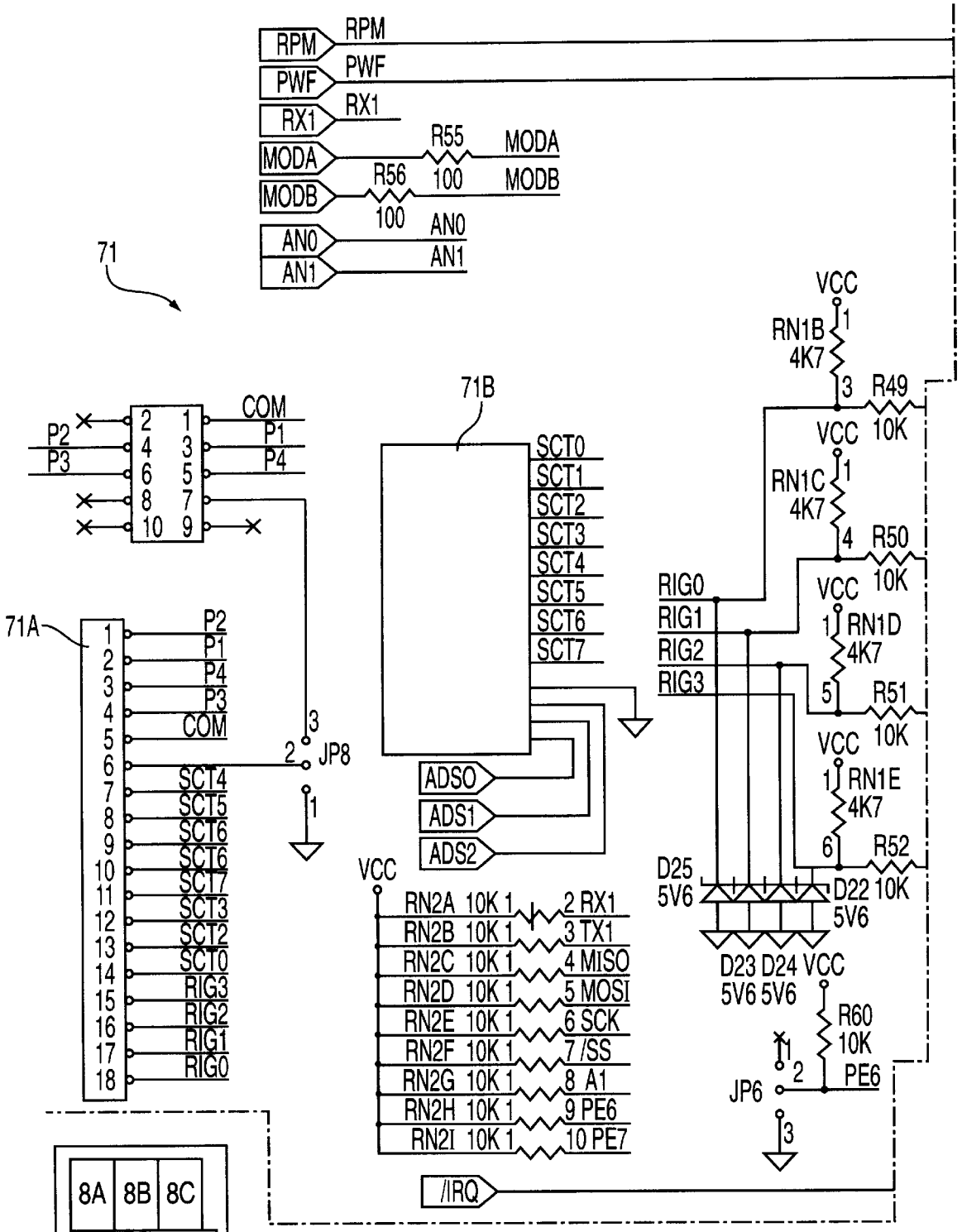
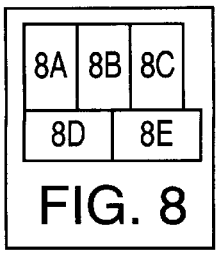
FIG. 8
FIG. 8A

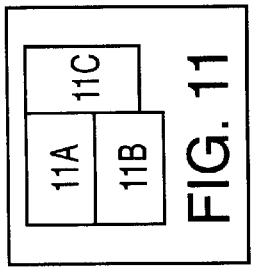
FIG. 11
FIG. 11A
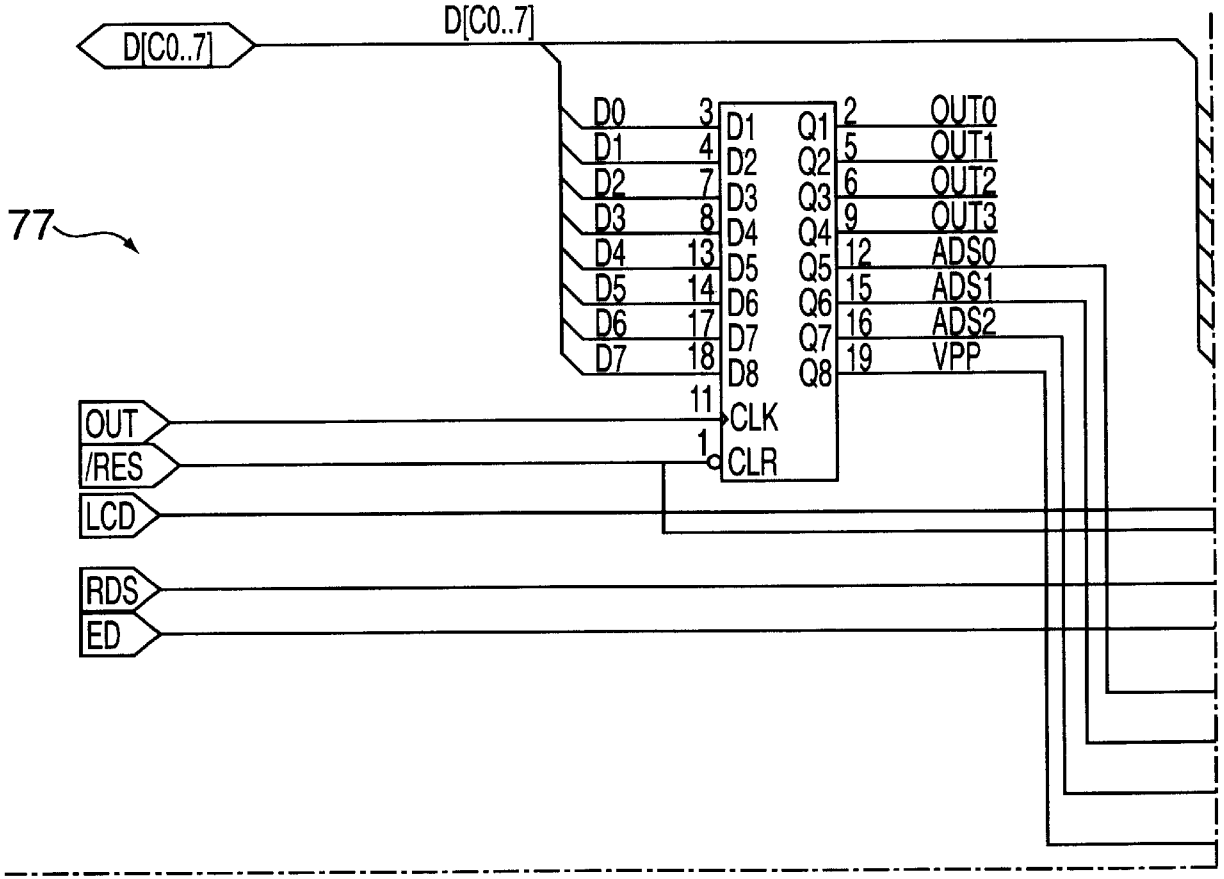

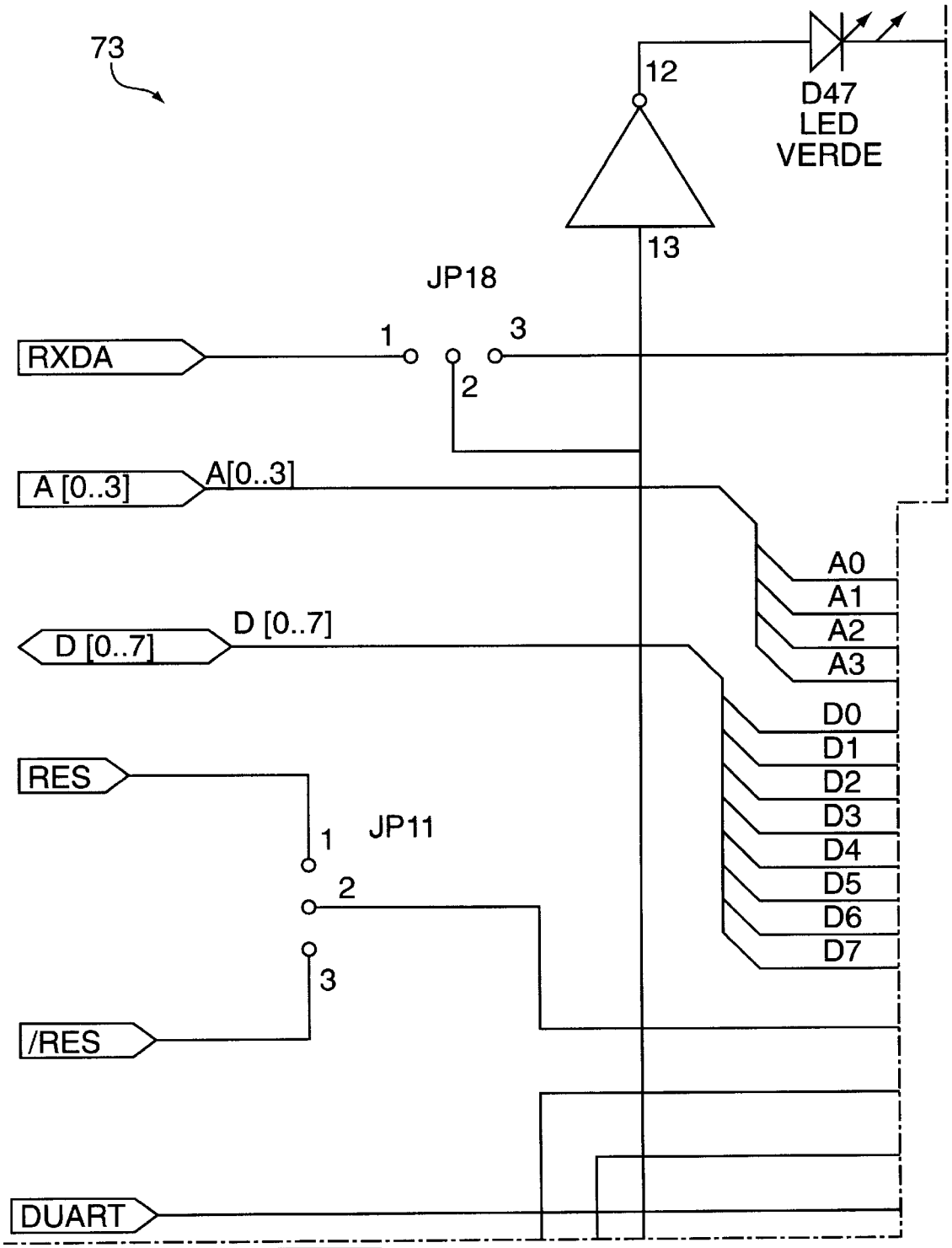
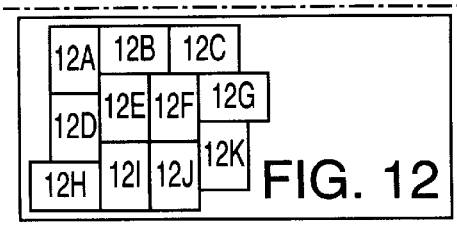
FIG. 12
FIG. 12A

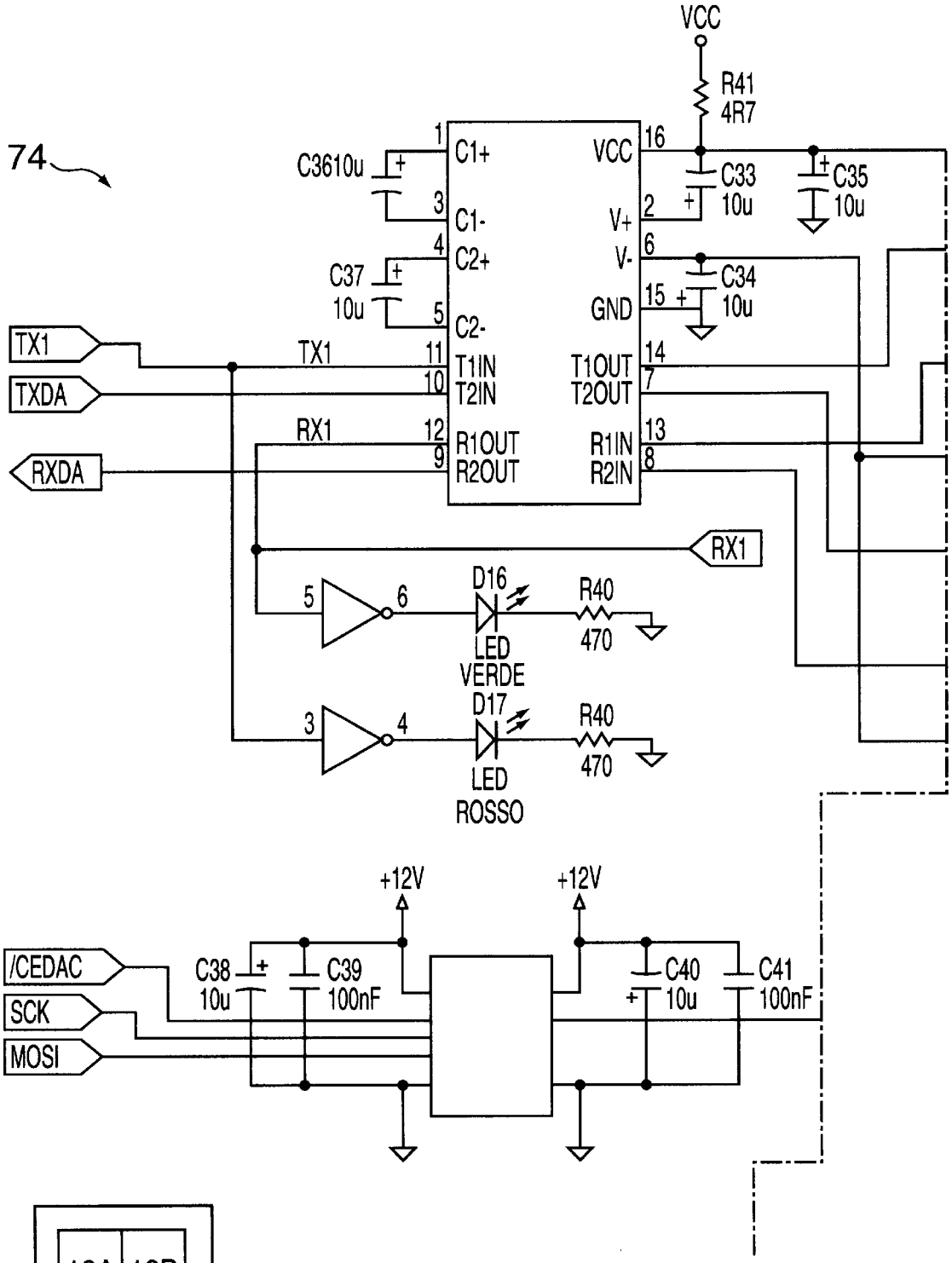
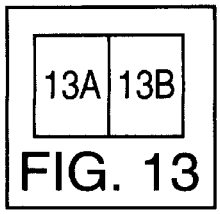
FIG. 13
FIG. 13A

TENSIONING UNIT WITH AUTOMATIC TENSION CONTROL FOR YARN-FORMED FABRICS

This invention relates to a tensioning unit (or more commonly tensioner) with automatic tension control for yarn-formed fabrics. The yarn tension plays an important role in winding. In this respect, too high a tension can damage the yarn whereas too low a tension can produce an unstable package which cannot unwind regularly.

A common defect associated with packages wound with low tension is their tendency to produce falling turns which give rise to yarn entanglement.

Tension variations in the different parts of a winding can cause undesirable effects. For example, with many continuous-filament chemical fibres, high tension can cause molecular changes which influence dyeability, so that these tension variations appear on the fabric as bars of colour.

With discontinuous yarns, a tension sufficient to break the yarn interruptions during winding is usually used. This enables them to be eliminated and replaced with a knot, which has the advantage of being able to be passed onto the reverse side of the fabric by picking, but still represents a defect. In addition the variations in winding tension alter the level at which the interruptions are eliminated, this highlighting the yarn irregularity on the finished product.

Currently, tensioners take various forms, the most simple of which operates as a deviation pin, in which a predetermined entry tension is required before obtaining a tension increase. Other simple techniques are to use a weight to give a fixed tension increase, in accordance with the rules of additive systems. This type of tensioner enables the required tension to be obtained but not to be reduced. The only method to achieve this is to use a positive drive, which however tends to overfeed. Other more sophisticated systems incorporate automatic control of yarn tension. Of these the most simple and most common is the compensation lever. The yarn tension acts on a pin at the free end of a lever to alter the pressure acting on a disc, which in its turn modifies the tension. The system is regulated such that when the yarn tension is too high, the pressure exerted in the disc region is reduced to cause it to return to the desired level. From the technical viewpoint this represents a negative feeder. However this type of control has numerous drawbacks. Firstly it is incompatible with a wide range of operating speeds, and in addition it tends to increase the tension variations and to modify yarn twist. Finally, yarn tension regulation is negatively influenced by the wear of the various components with time. All this inevitably results in yarn package instability, or rather an inability of the package to resist deformation. It is apparent that a package which collapses causes yarn disorder, making it unusable and resulting in wastage (the consequences in warping are particularly serious).

An object of the present invention is therefore to indicate a tensioning unit with automatic tension control for yarn-formed fabrics, which obviates the aforesaid drawbacks, ie to provide a tensioning unit which enables the tension of the yarn-formed fabrics to be maintained constant for any yarn travel speed, in order to obtain a yarn package which preserves its form and structure even after being handled a considerable number of times, and allows rapid yarn unwinding in all subsequent weaving operations.

A further object of the present invention is to indicate a tensioning unit with automatic tension control for yarn-formed fabrics, which has a wide range of application and is compatible with a large range of operating speeds.

A further object of the present invention is to indicate a tensioning unit which allows rapid threading, without causing or increasing yarn tension variations.

A further object of the invention is to provide a tensioning unit with automatic tension control for yarn-formed fabrics, the characteristics of which are not influenced by component wear.

A further object of the invention is to provide a tensioning unit with automatic tension control for yarn-formed fabrics, which does not require the use of complex or particularly costly techniques, is simple to use and substantially reduces operating times and production losses compared with known methods.

These and further objects are attained by a tensioning unit with automatic tension control for yarn-formed fabrics in accordance with claim 1, to which reference should be made for brevity. Advantageously the tensioning unit of the invention comprises two electronic cards, one of which is mounted in two separate devices. A first electronic card, mounted in an electromechanical cubicle, acts as the control terminal from which the drawing parameters can be set or memorized, and applicational drawing programs be loaded. An identical electronic card is mounted on the tensioning unit, its purpose being to directly control a drawing motor in response to a feedback signal originating from a linear position transducer rigid with a tensioning spring for the yarn-formed fabric.

A second electronic card provides communication between a fixed unit and a rotating unit by means of a serial line; to achieve this an infrared optical coupling system is used.

At each speed variation of the fabric the spring system reacts to maintain the fabric under tension and provide information to an applicational program regarding the spring position, via a linear potentiometer; control is effected by increasing or decreasing the speed of the motor (rigid with a fabric take-up roller) on the basis of the information received regarding the spring position, such as to maintain the tension constant.

Further objects and advantages of the present invention will be apparent from the following description and the accompanying drawings, which are provided by way of non-limiting example and in which.

Figure 1:
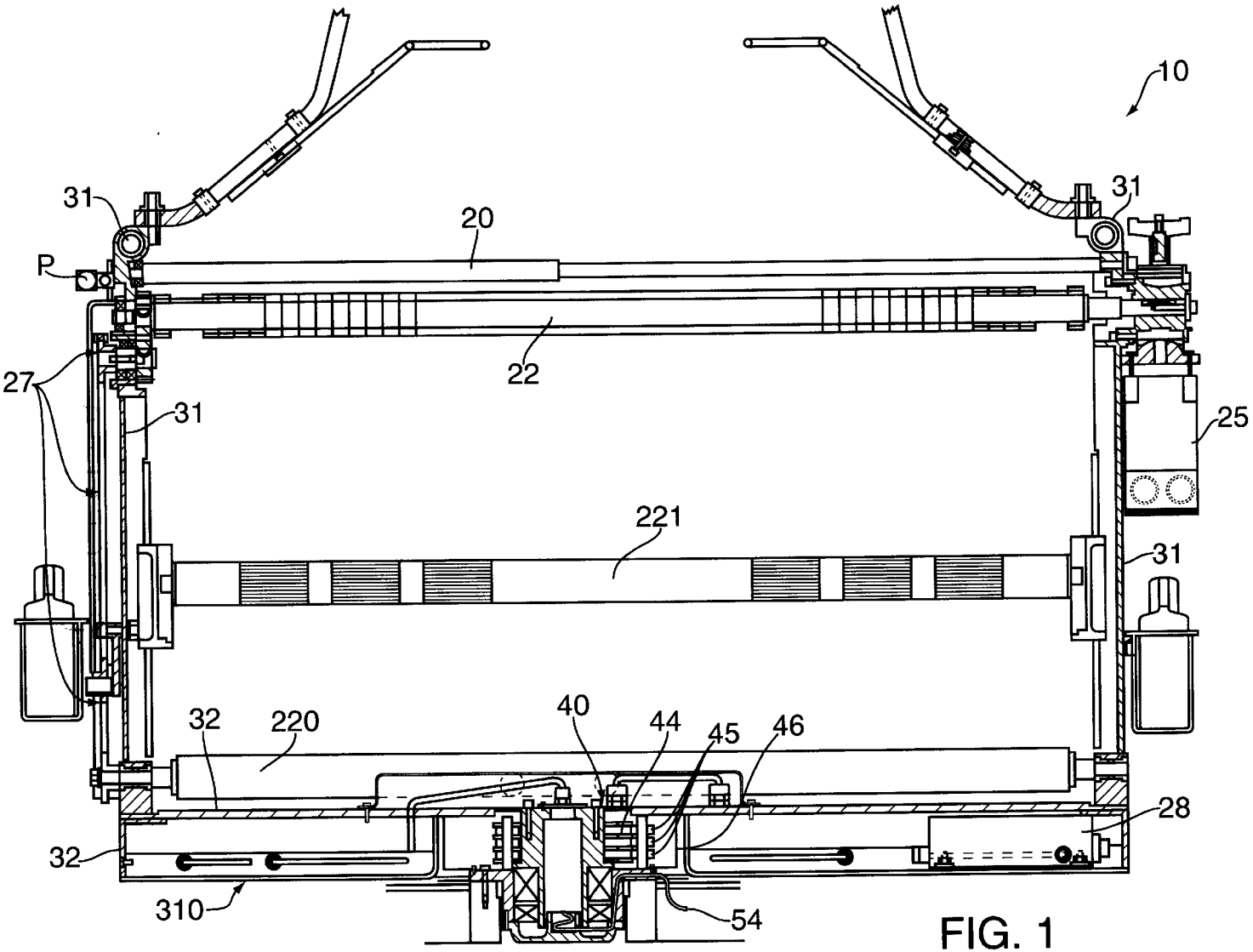
FIG. 1 is a partly sectional front elevation of a tensioning unit according to the present invention.
Figure 3:
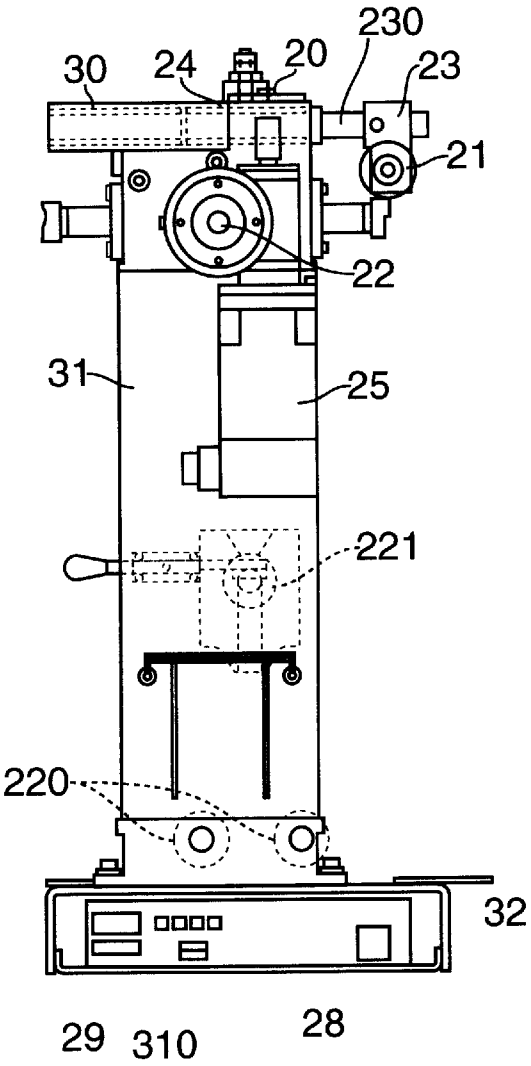
FIG. 3 is a second side view of the tensioning unit of FIG. 1.

In said figures, the reference numeral 10 indicates overall a tensioning unit with automatic tension control for yarn-formed fabrics F according to the present invention, comprising a fixed support structure 31, a bearing roller 20 about which the entering yarn-formed fabric F is passed, a tensioning roller 21 for tensioning the fabric F and two take-up rollers 22 for the fabric F.

The tensioning roller 21 is rigid with a block 23 fixed to a shaft 230 which slides on a set of bearings 24 within the support structure 31 of the tensioning unit 10.

At one end of the shaft 230 there is housed a thrust spring 30 suitably preloaded by an adjustment know 231 to tension the tensioning roller 21 for the fabric F, this roller being connected to a linear position transducer (or potentiometer) P.

The entire assembly is fixed to the support structure 31 of the tensioning unit 10 and is rigid with the slider C of the linear position transducer P.

The end of the yarn-formed fabric F passes between the take-up rollers 22, which are positioned parallel to each other, at least one of them being rigid with the shaft of a non-ventilated induction motor 25 which rotates at a speed such as to maintain the tension of the yarn-formed fabric F constant when the speed at which the fabric F travels about the bearing roller 20 of the tensioning unit 10 varies.

The tensioning unit 10 is operated by an operating key 26, the take-up rollers 22, the rollers 220 for supporting and rotating the fabric F and the fabric winding roller 221 being driven by a belt or chain drive 27 of known type.

Figure 2:
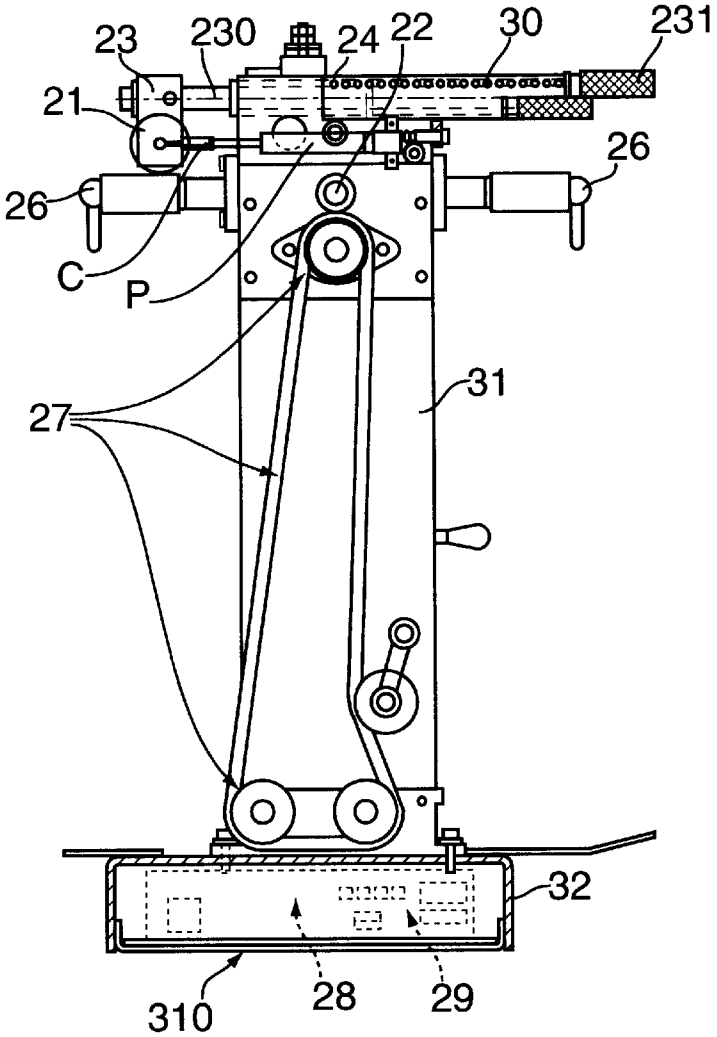
FIG. 2 is a first side view of the tensioning unit of FIG. 1.
Figure 4:
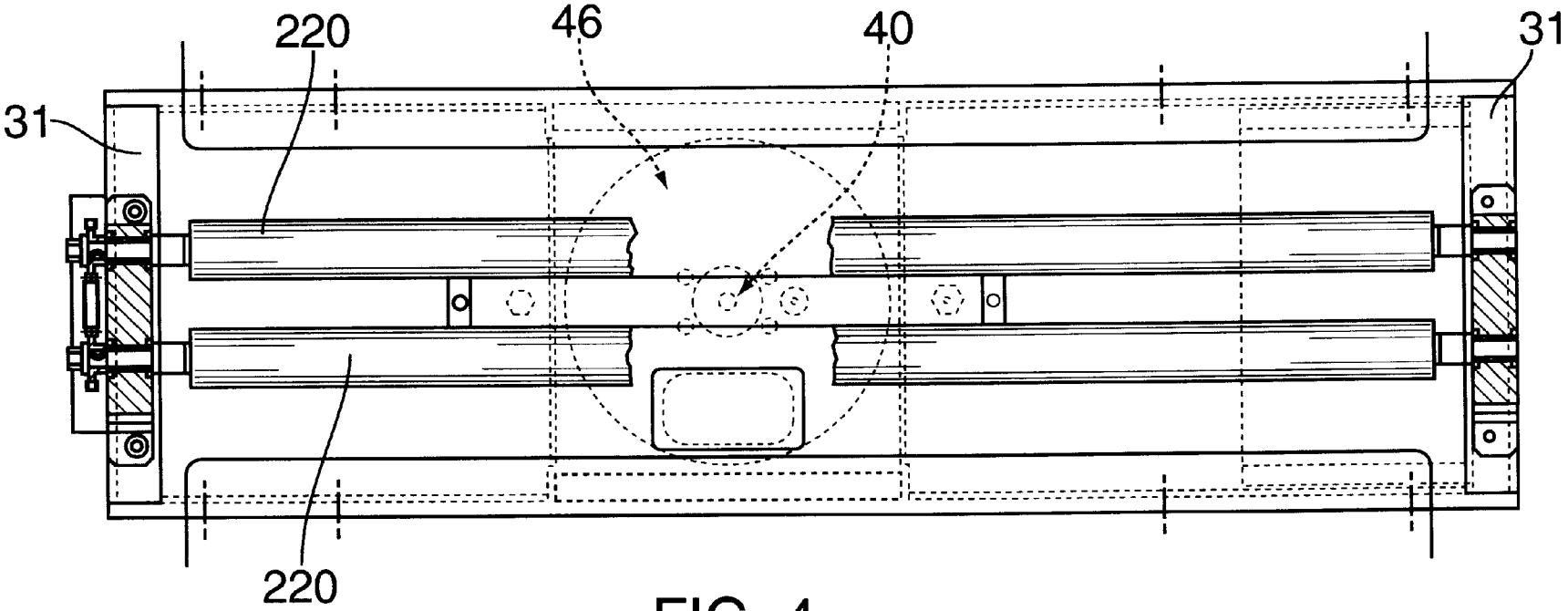
FIG. 4 is a partly sectional plan view of the tensioning unit of FIG. 1.
Figure 6:
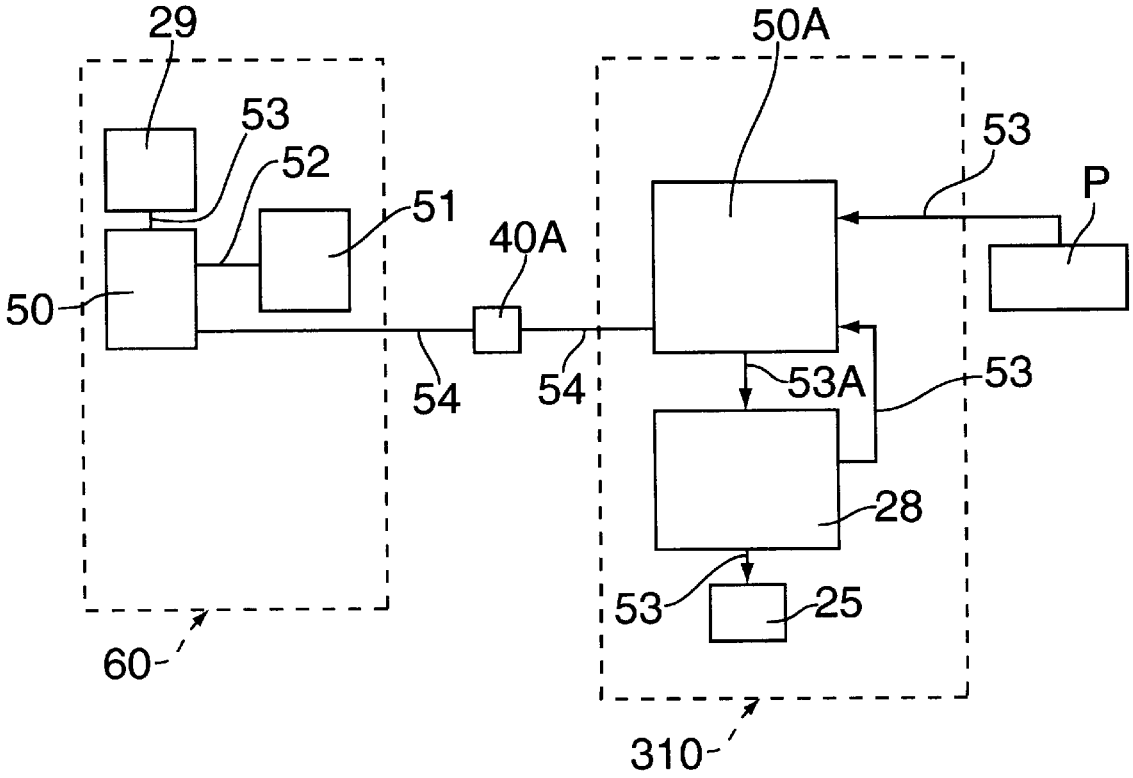
FIG. 6 is a block diagram of the automatic tension control system for yarn-formed fabrics in a tensioning unit of the present invention.
Figures 7, 7A:
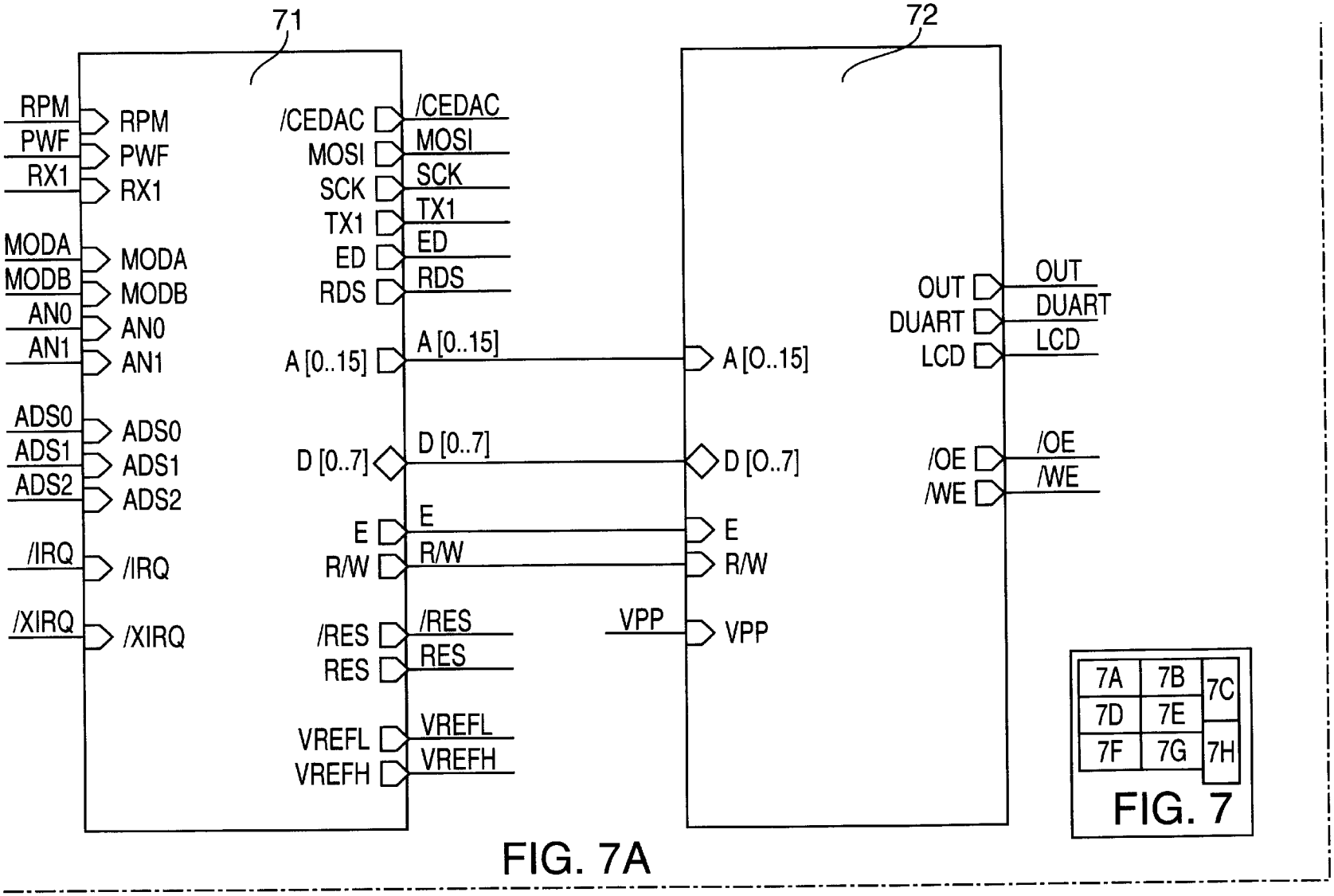
FIGS. 7–14 show circuit diagrams relative to a first electronic card used for automatically controlling a tensioning unit according to the present invention.
Figure 7B:
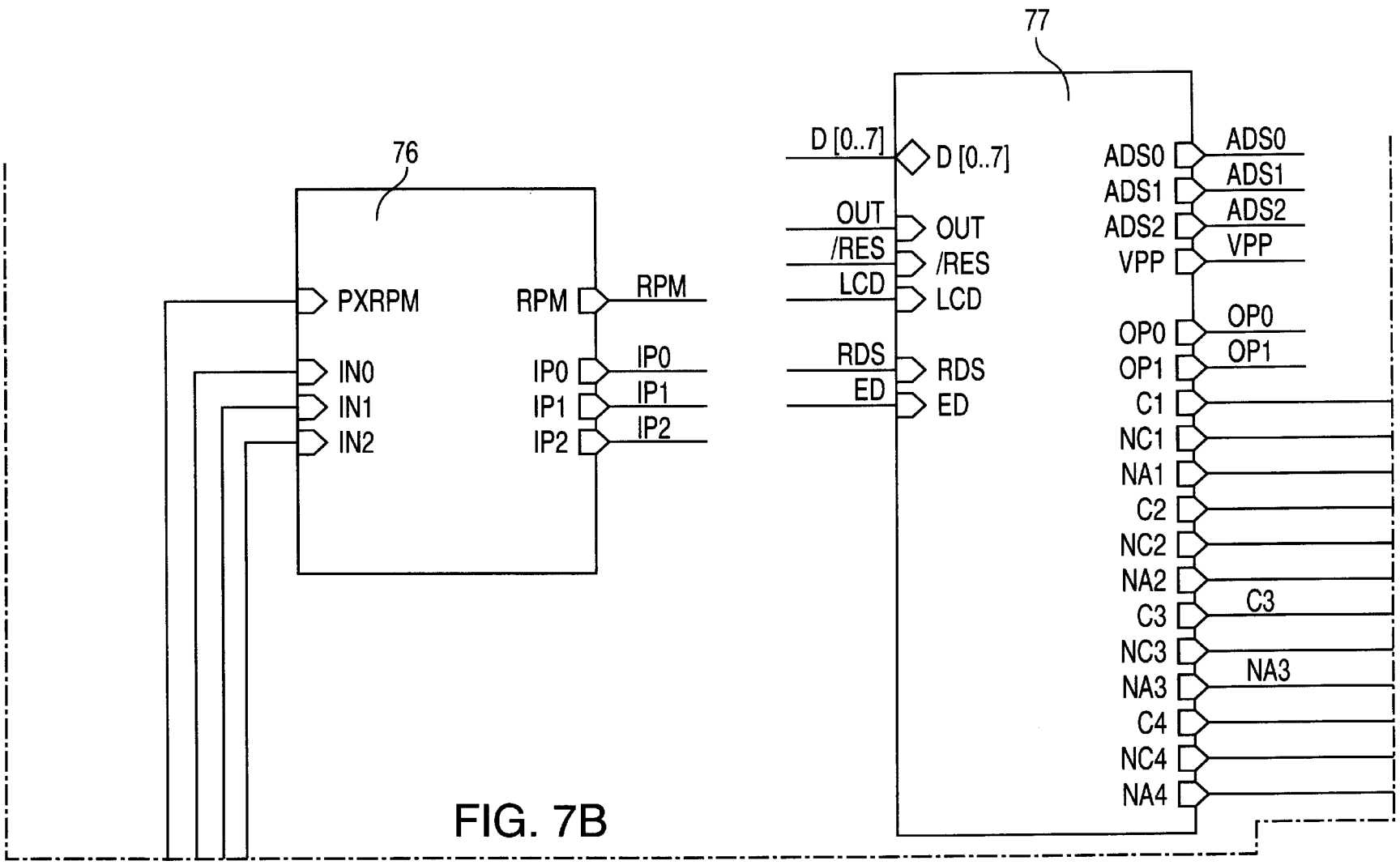
Figure 7C:
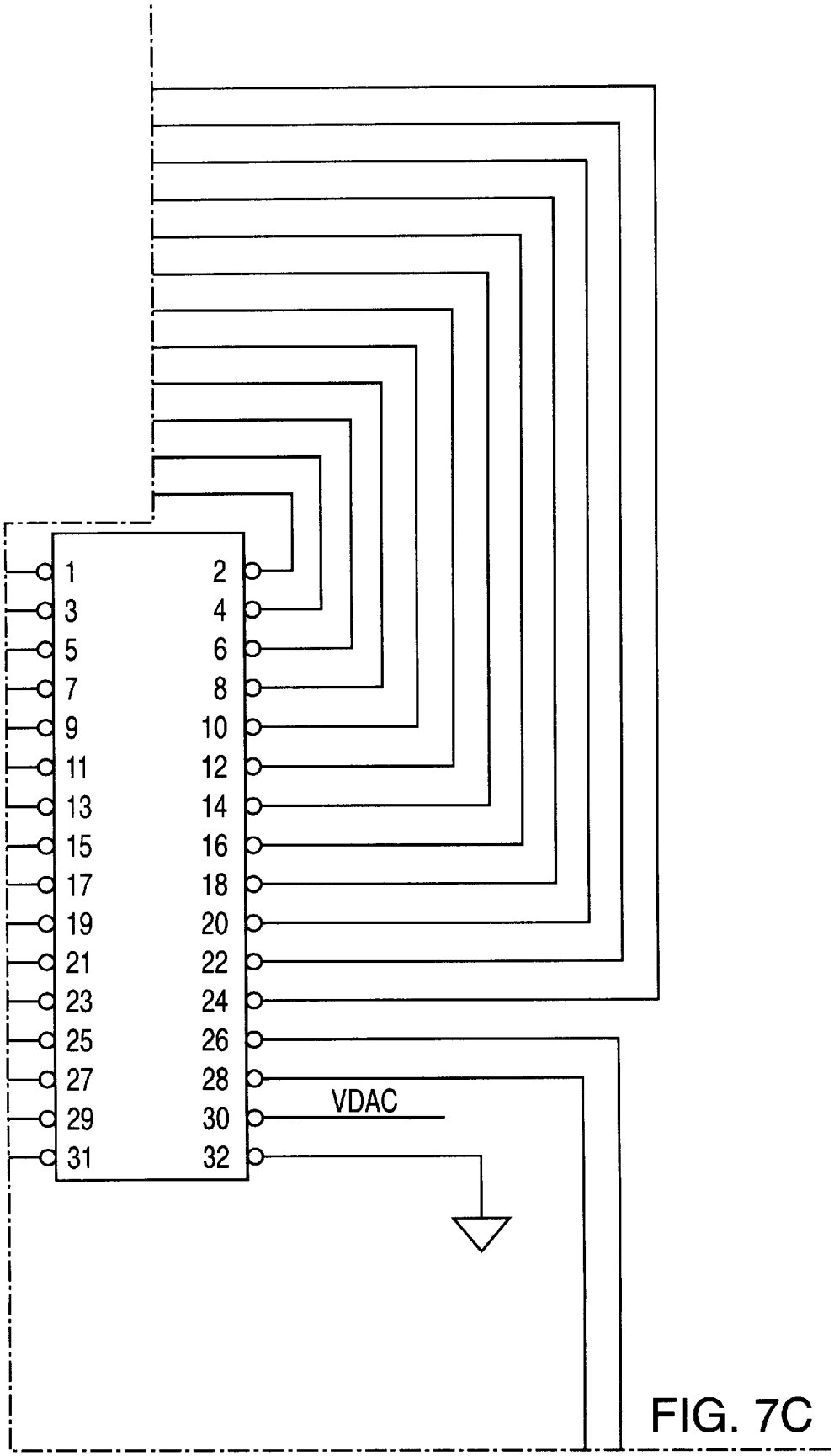
Figure 7D:
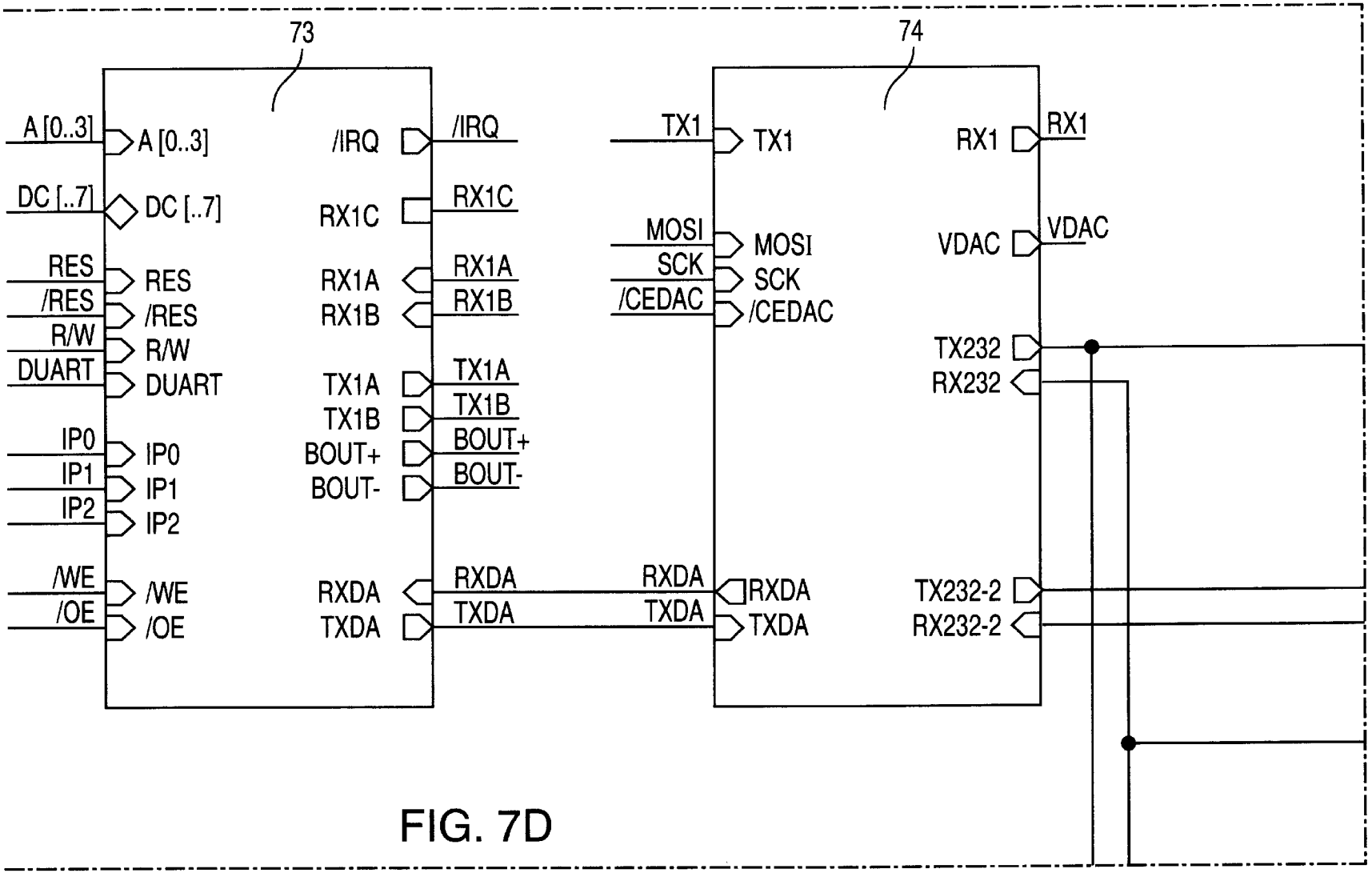
Figure 7E:
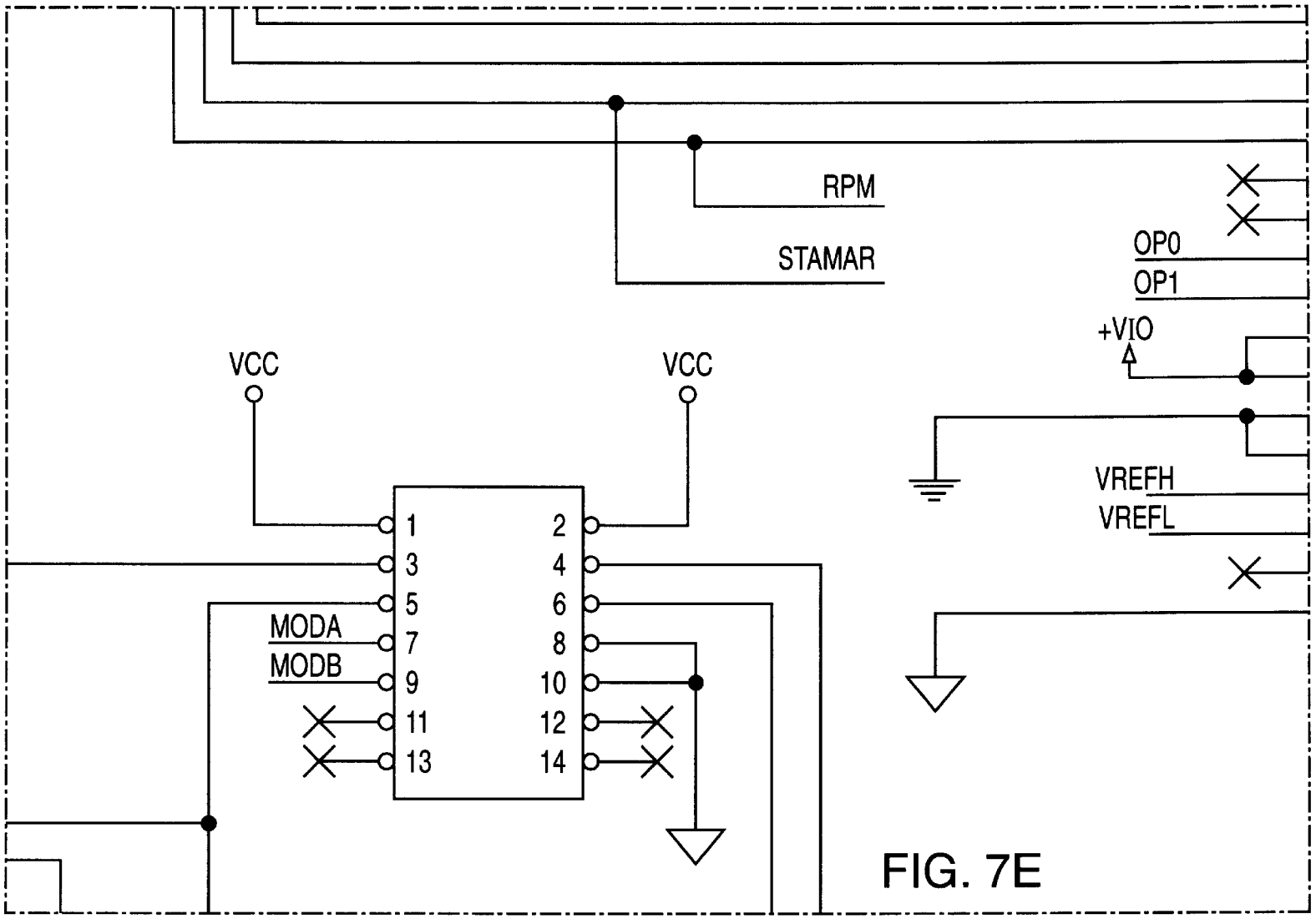
Figure 7F:
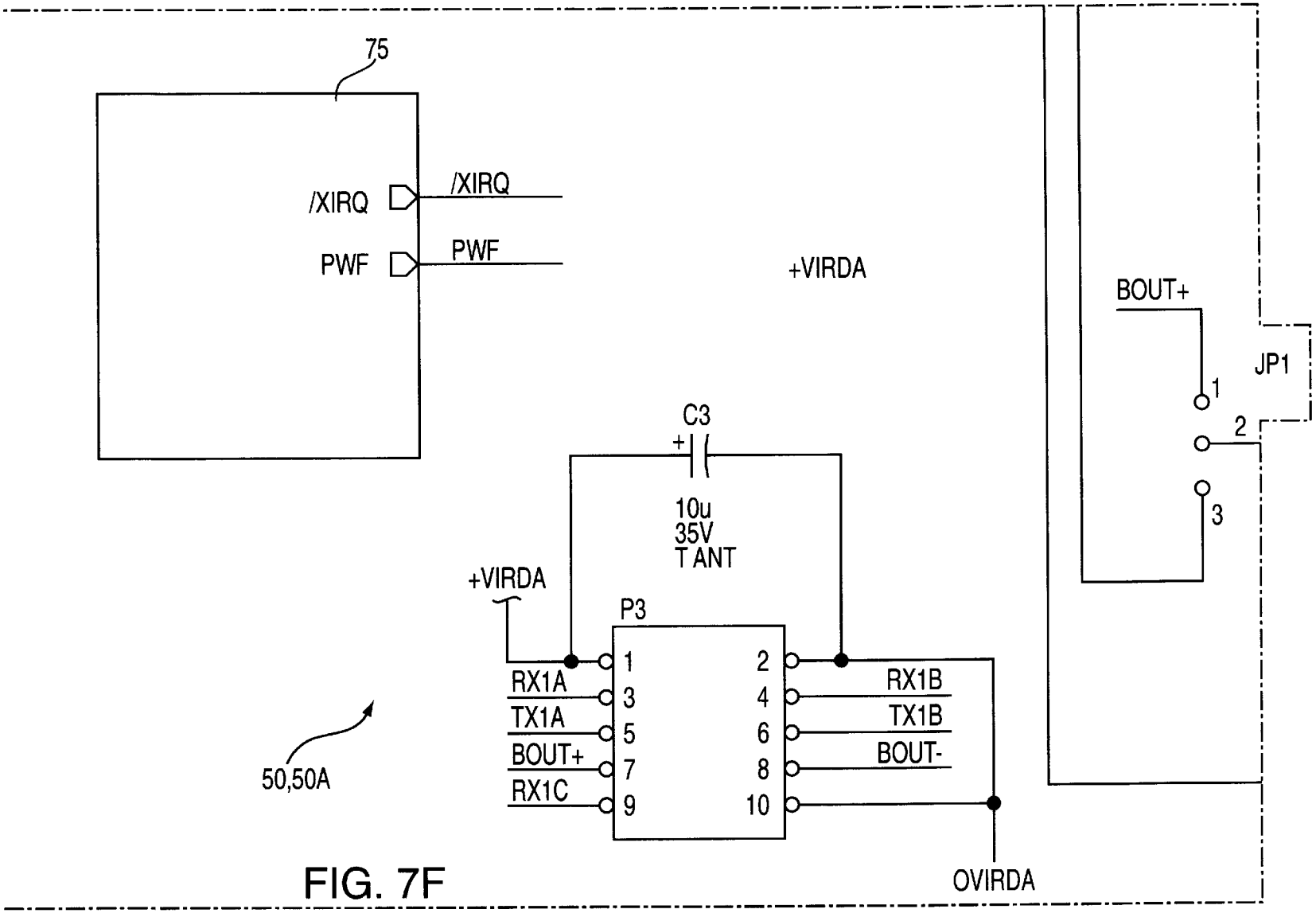
Figure 7G:
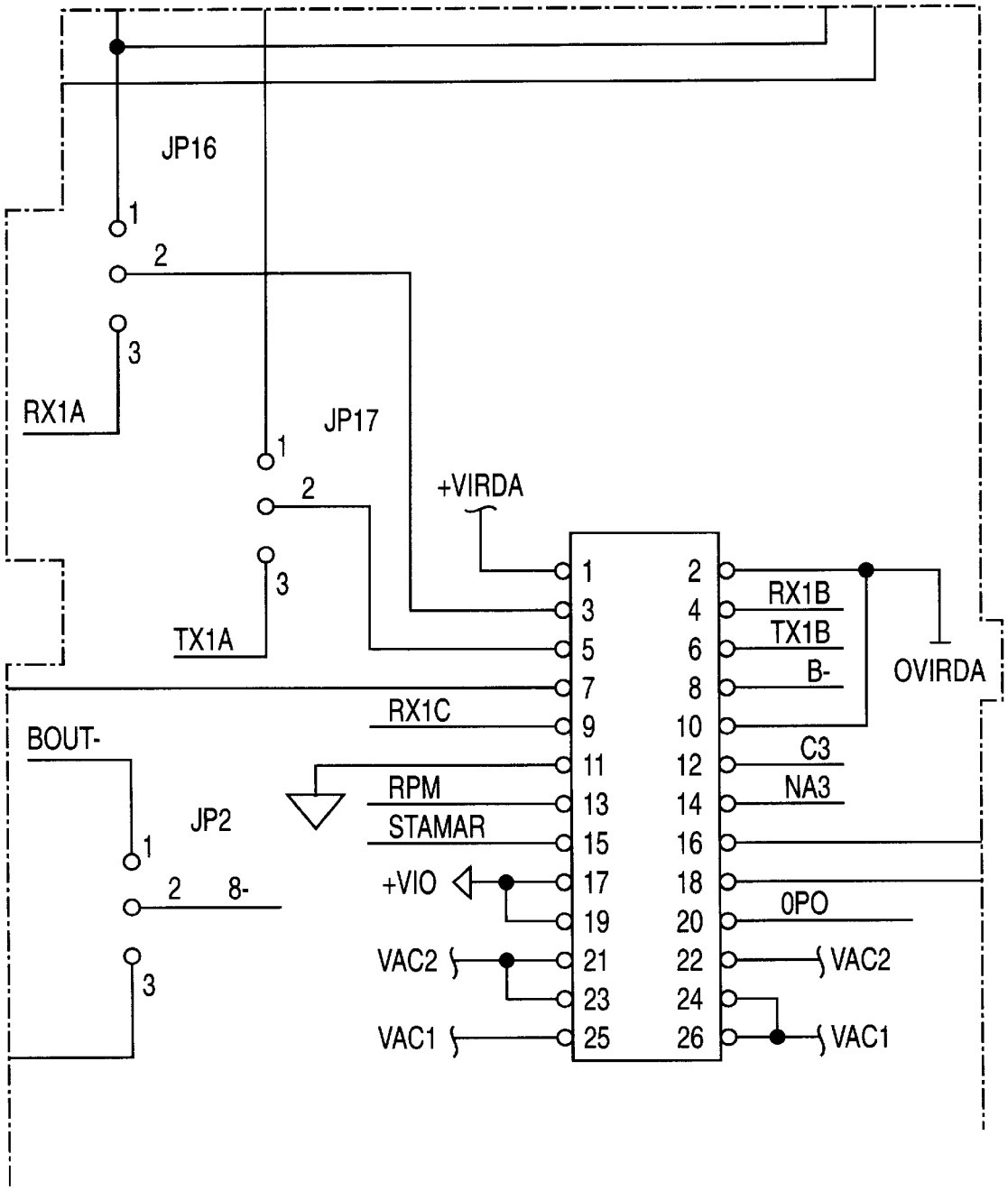
Figure 7H:
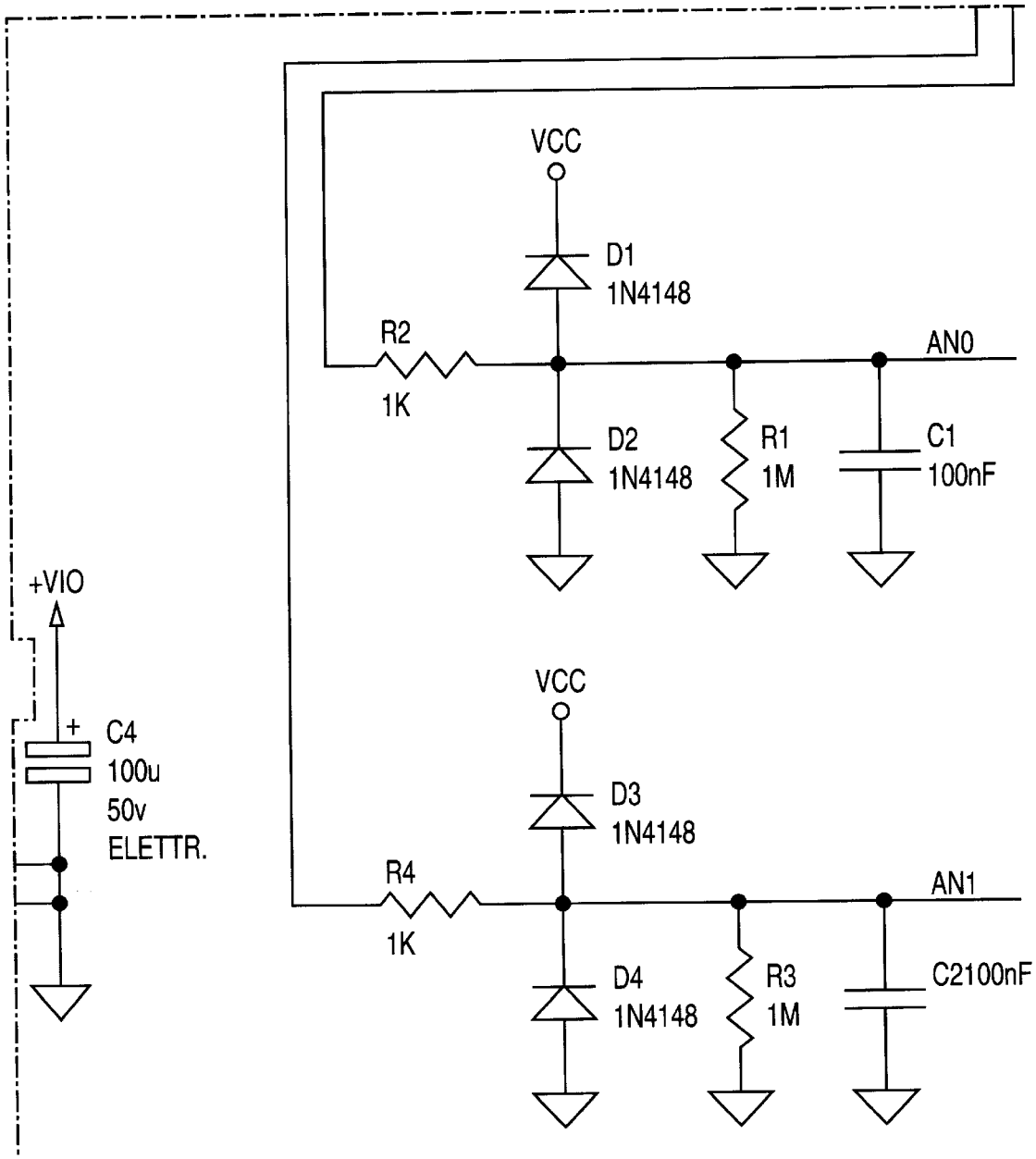
Figure 8B:
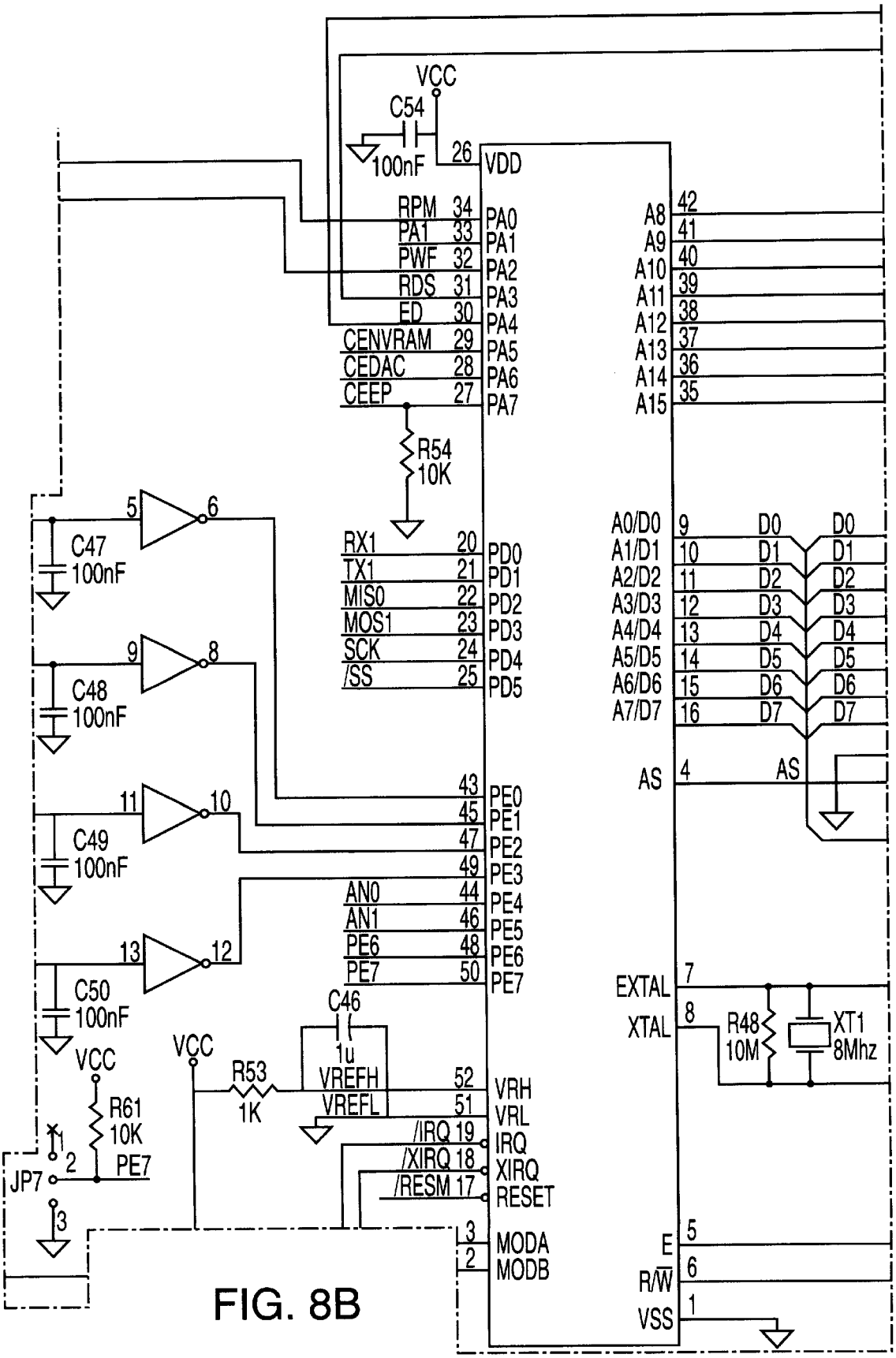
Figure 8C:
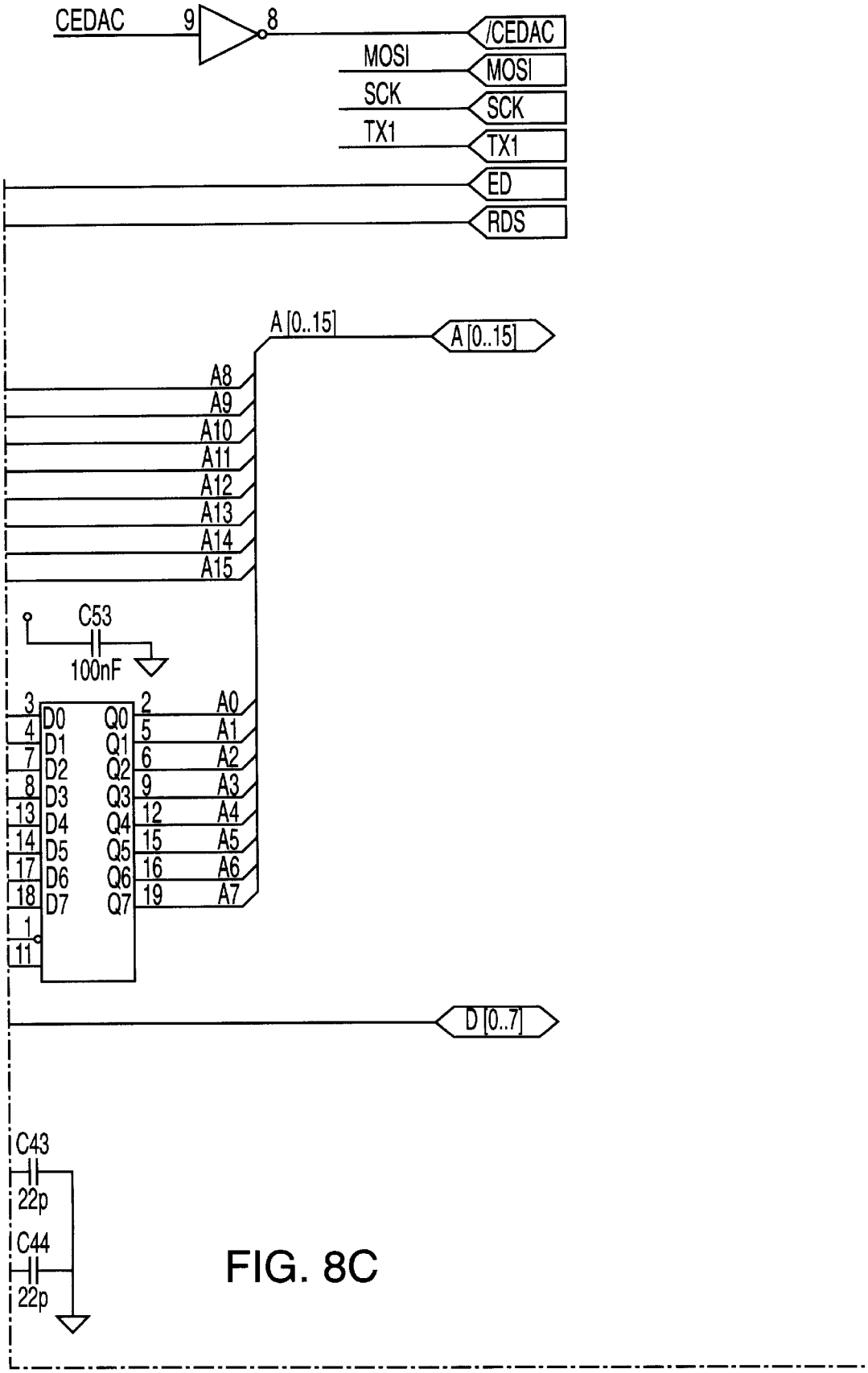
Figure 8D:
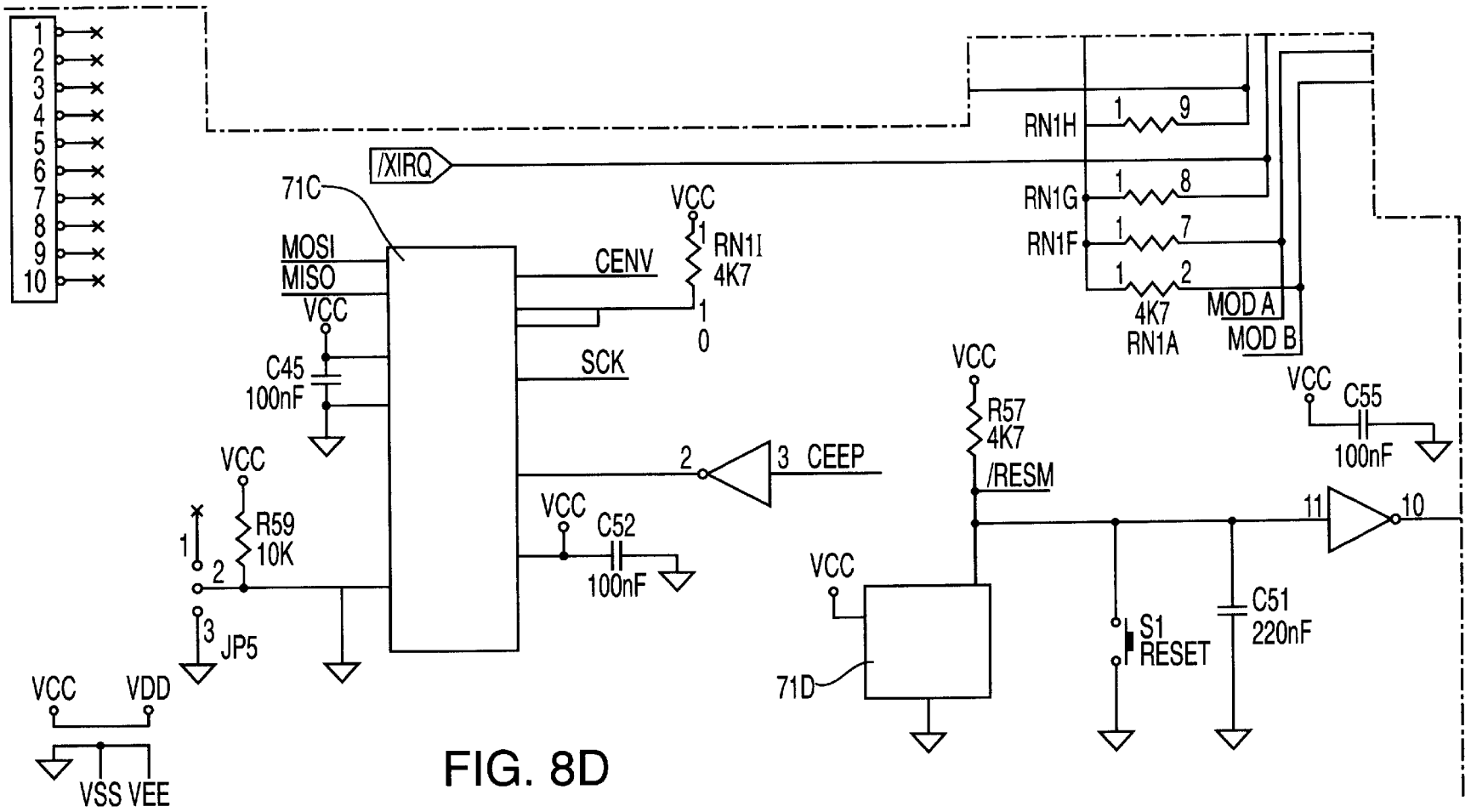
Figure 8E:
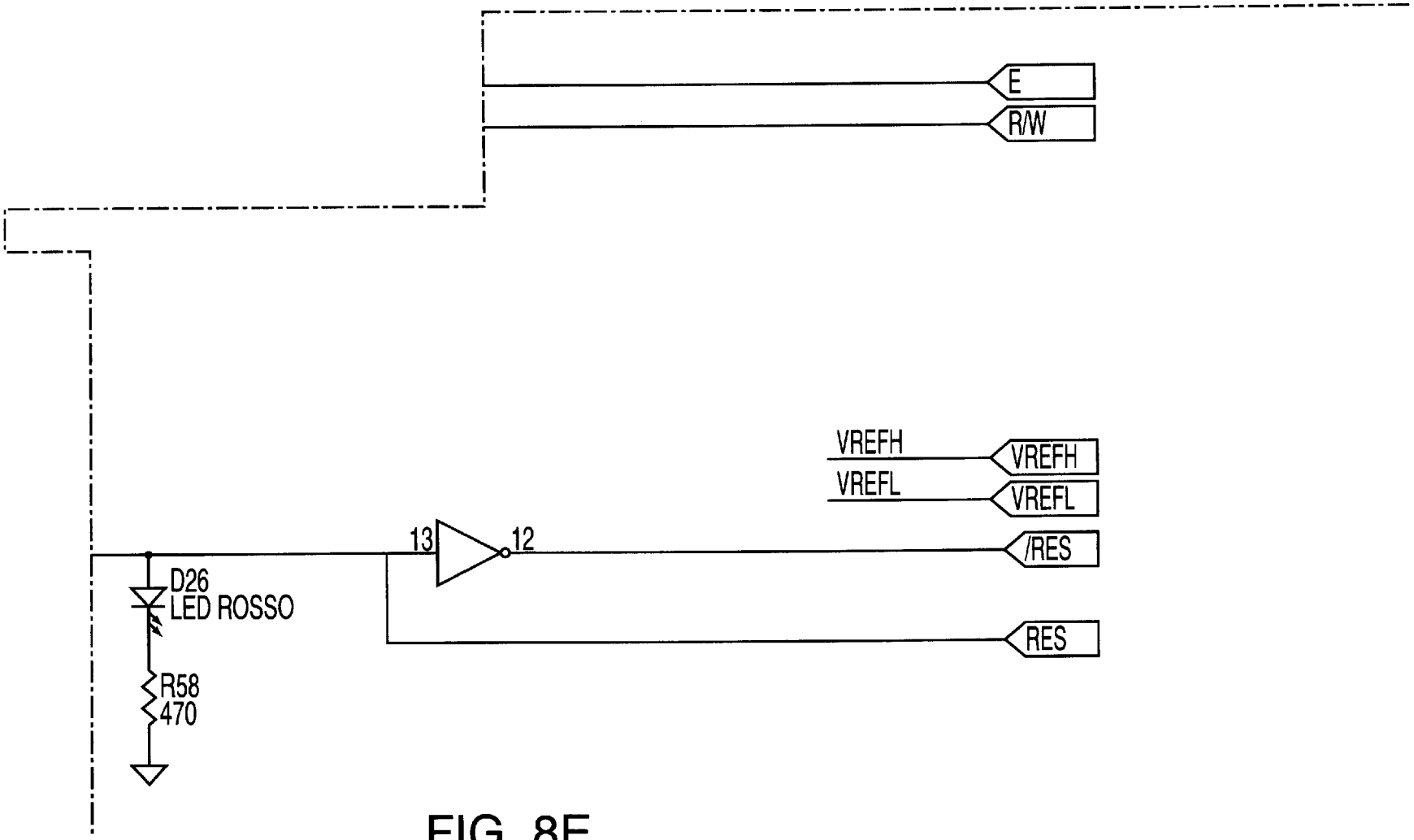
Figure 9:
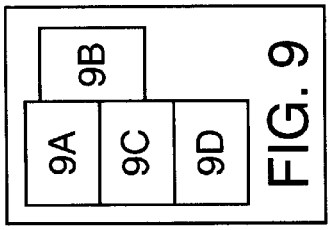
Figure 9A:
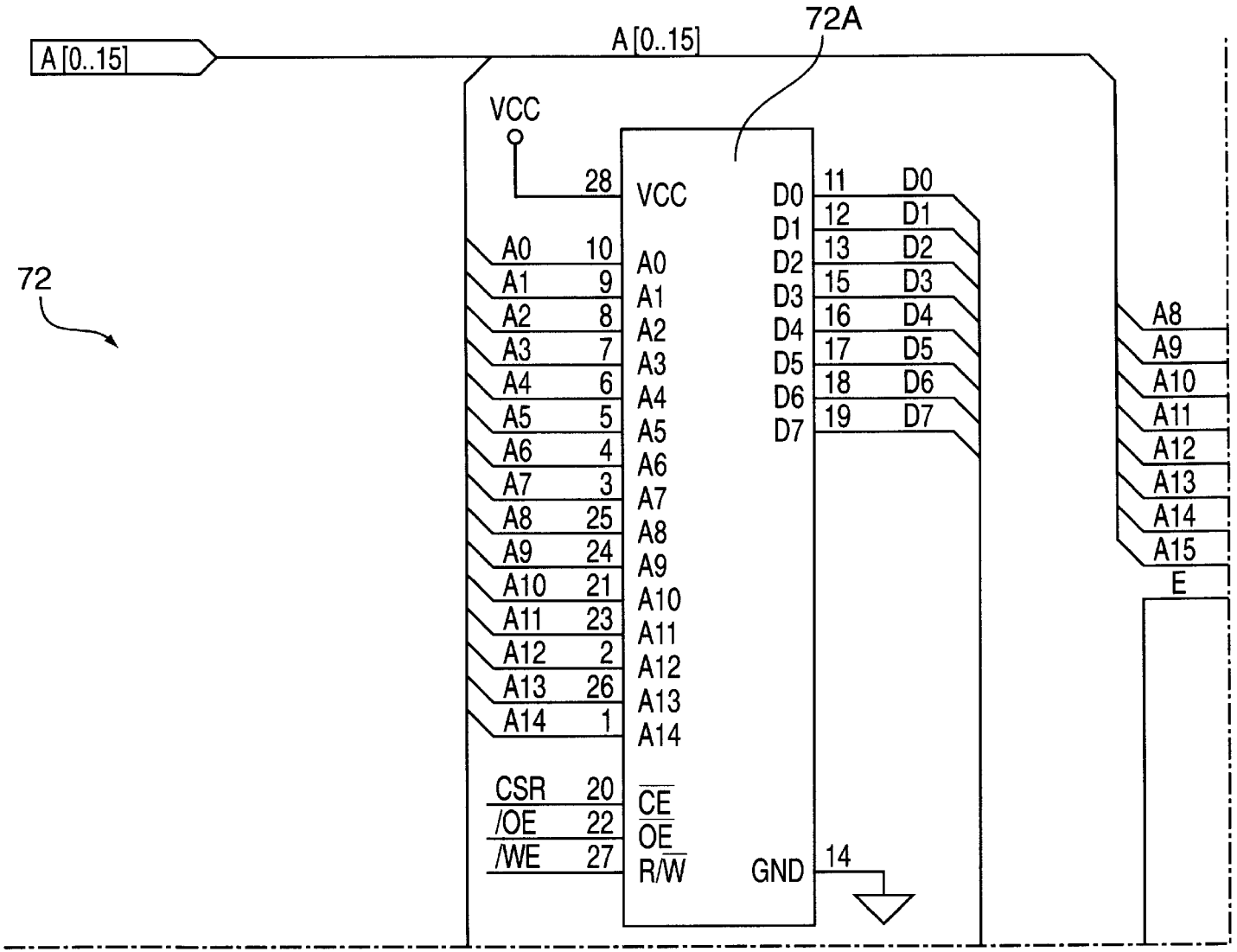
Figure 9B:
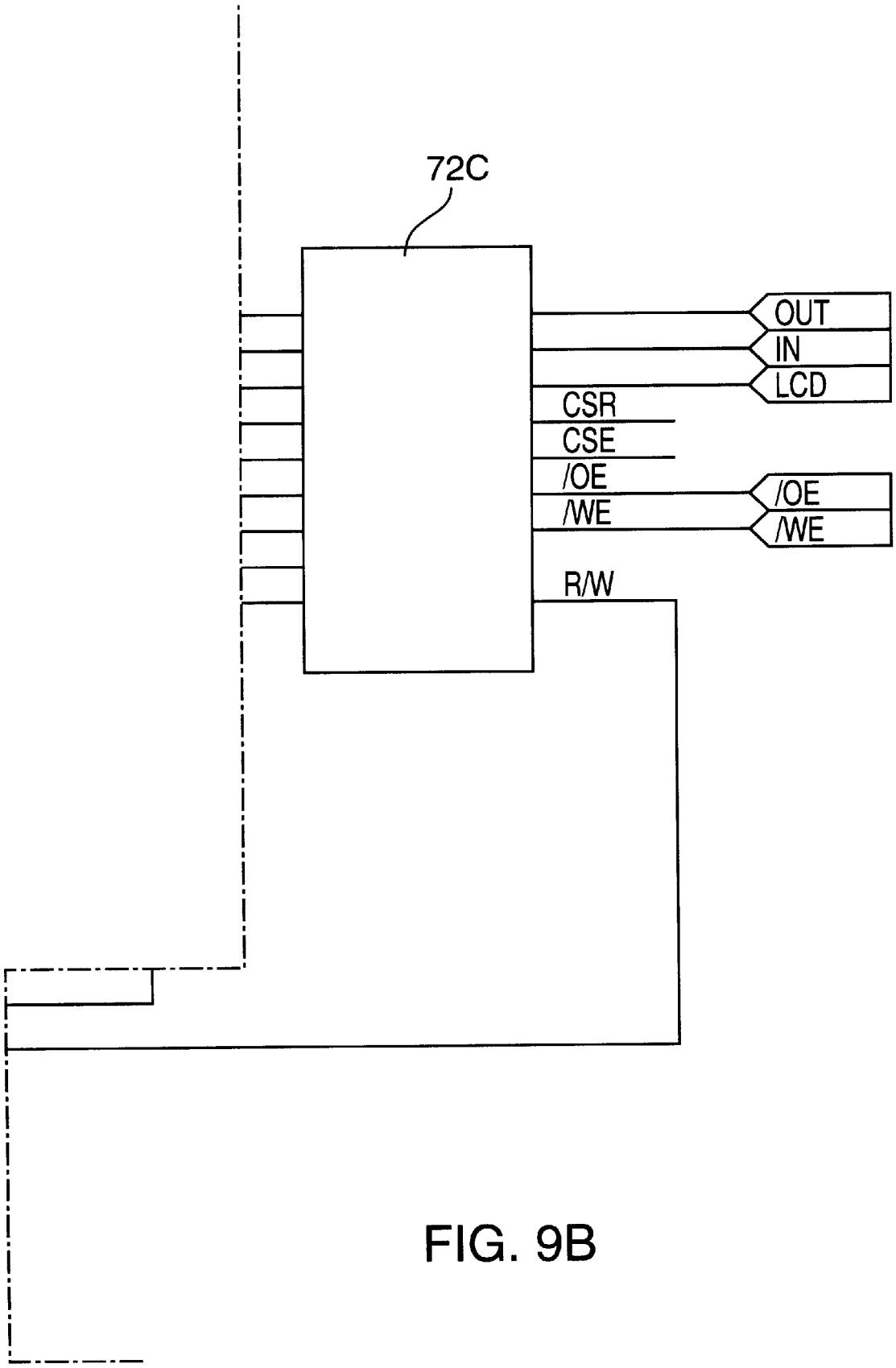
Figure 9C:
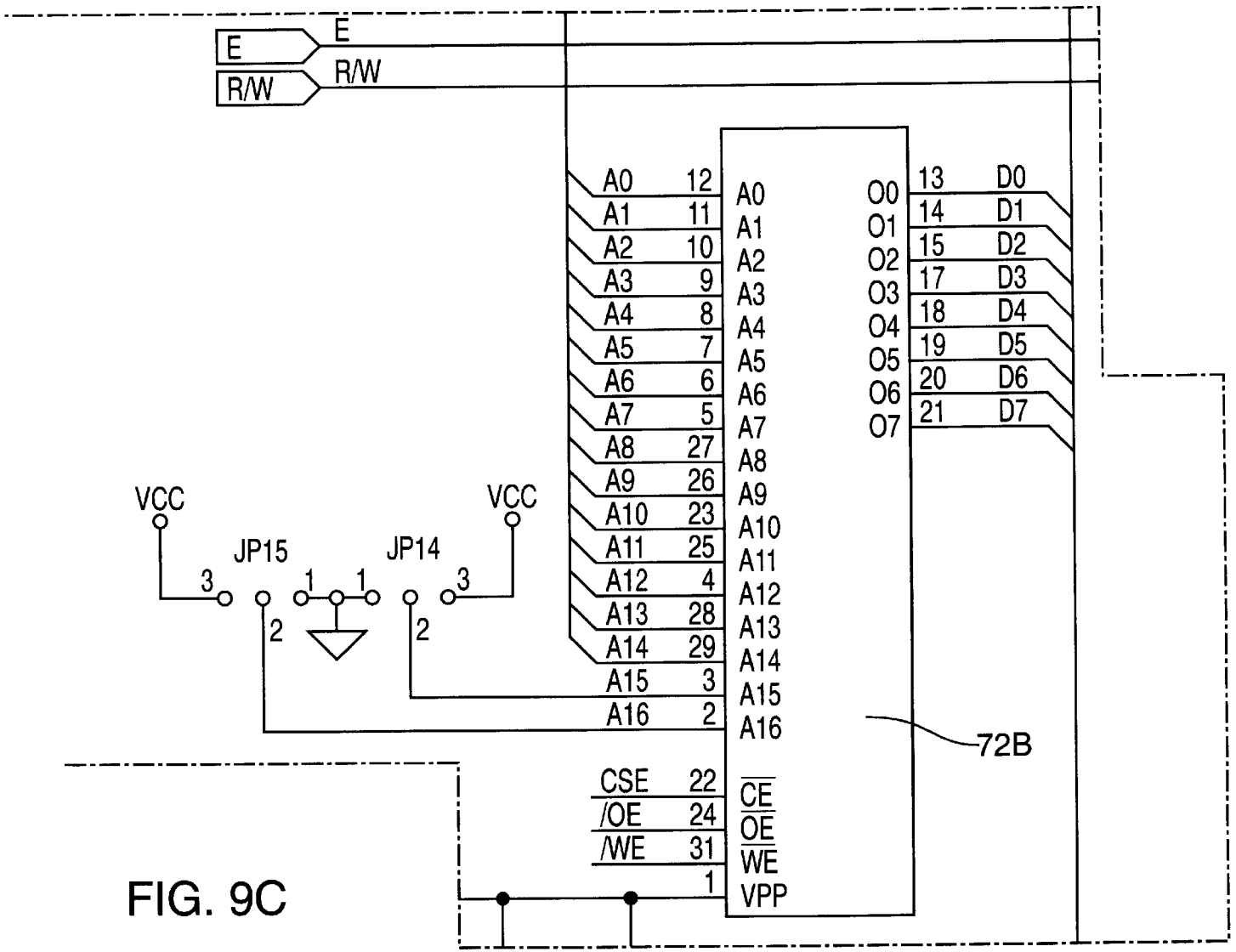
Figure 9D:
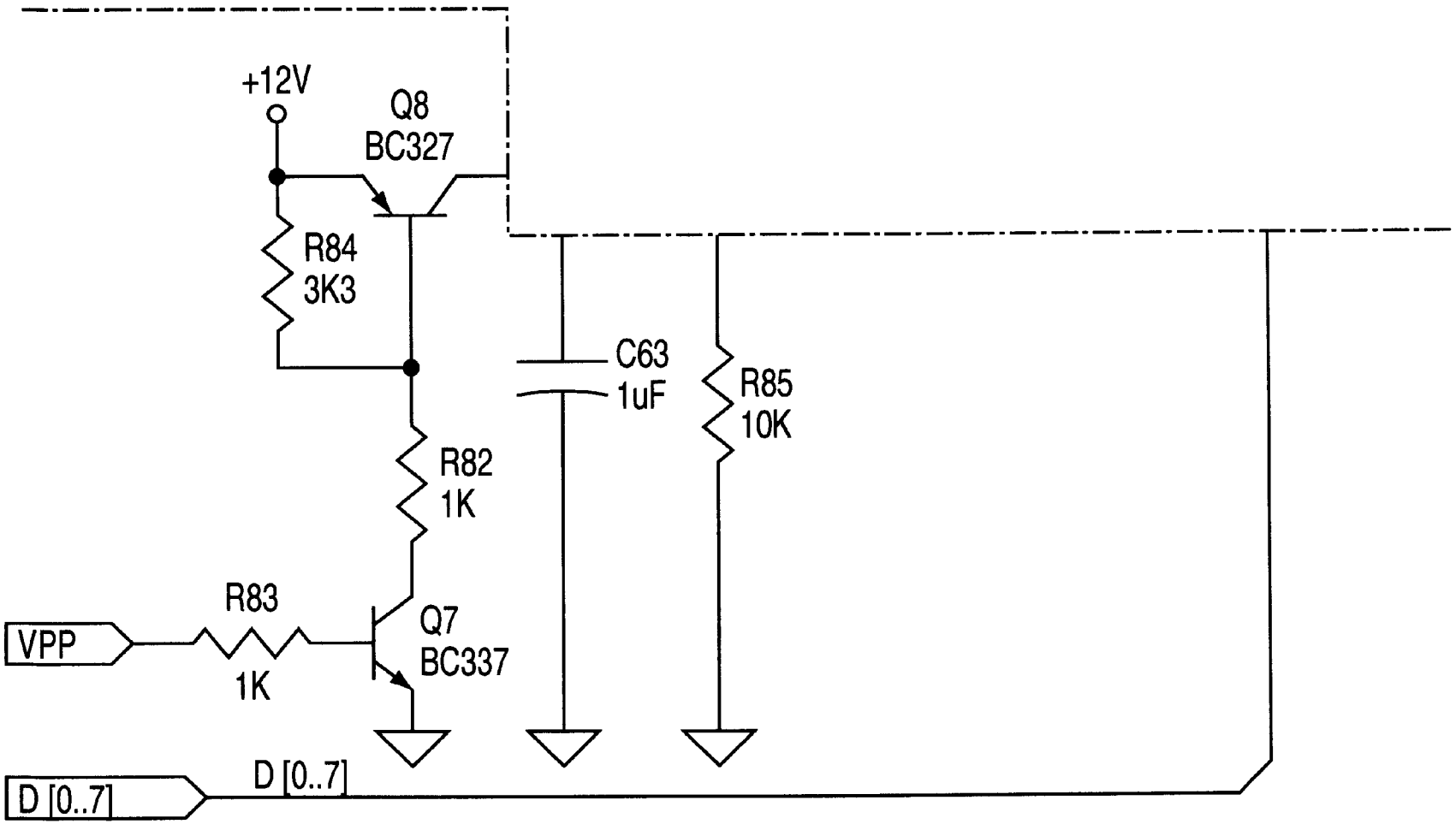
Figure 10:
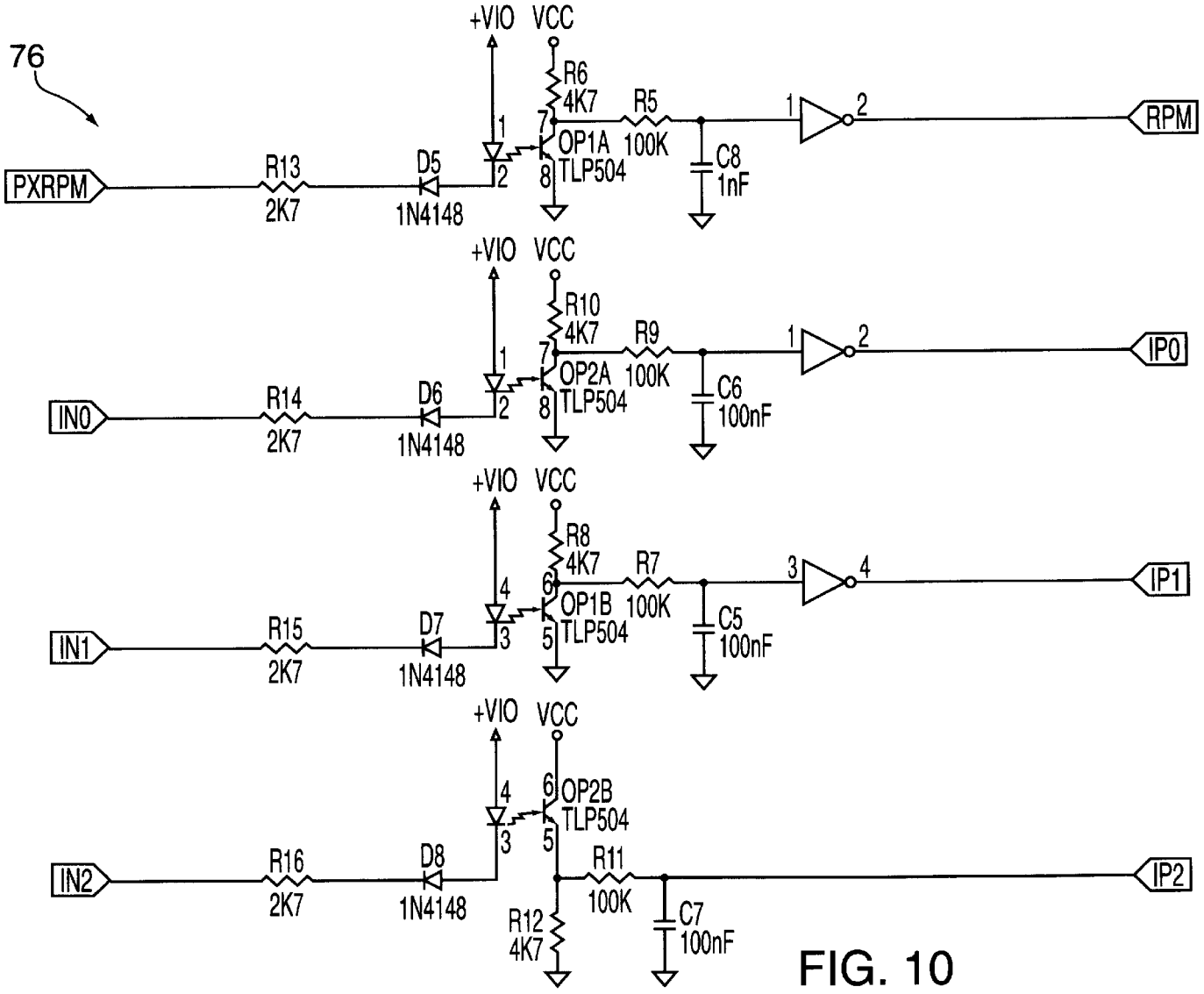
Figure 11B:
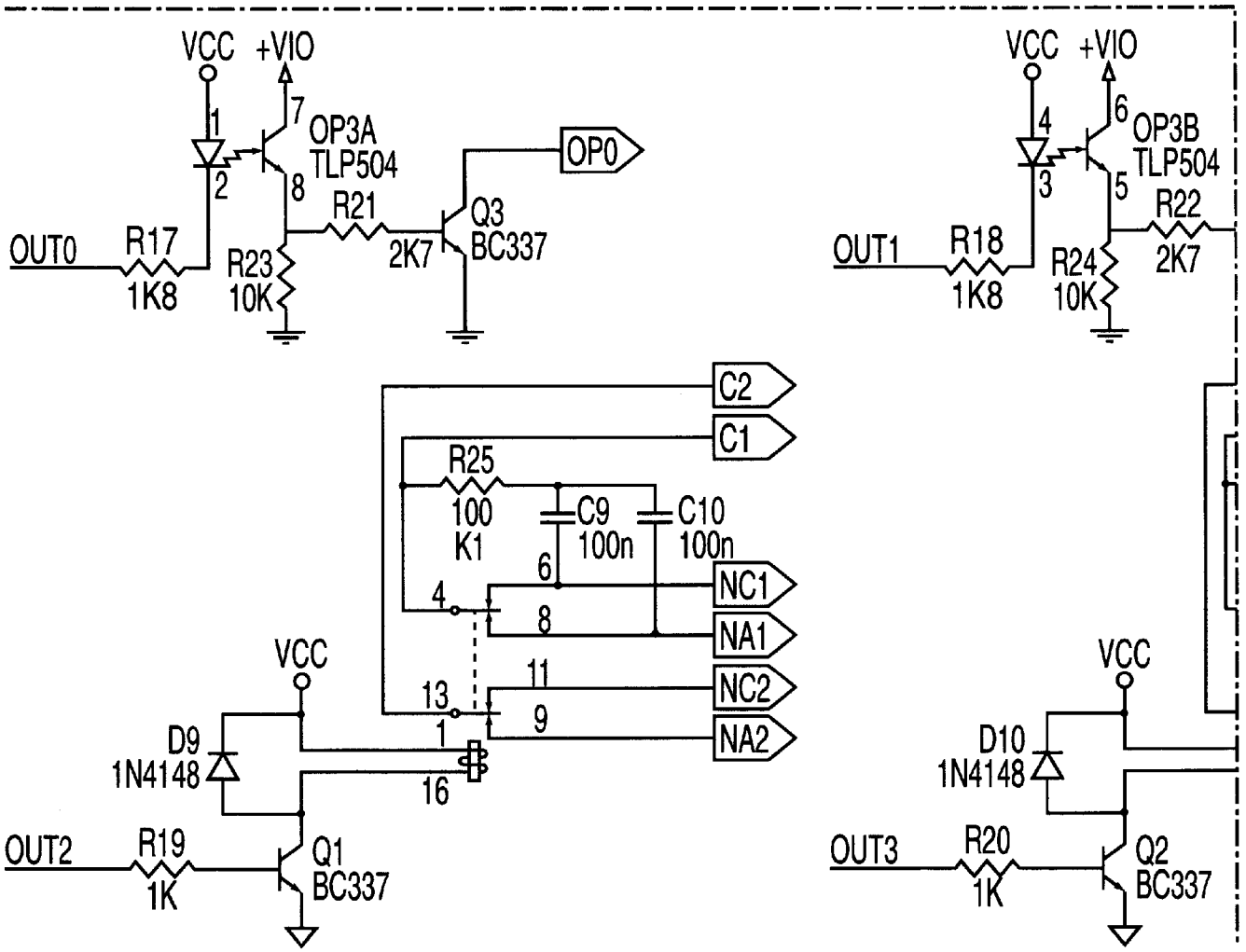
Figure 11C:
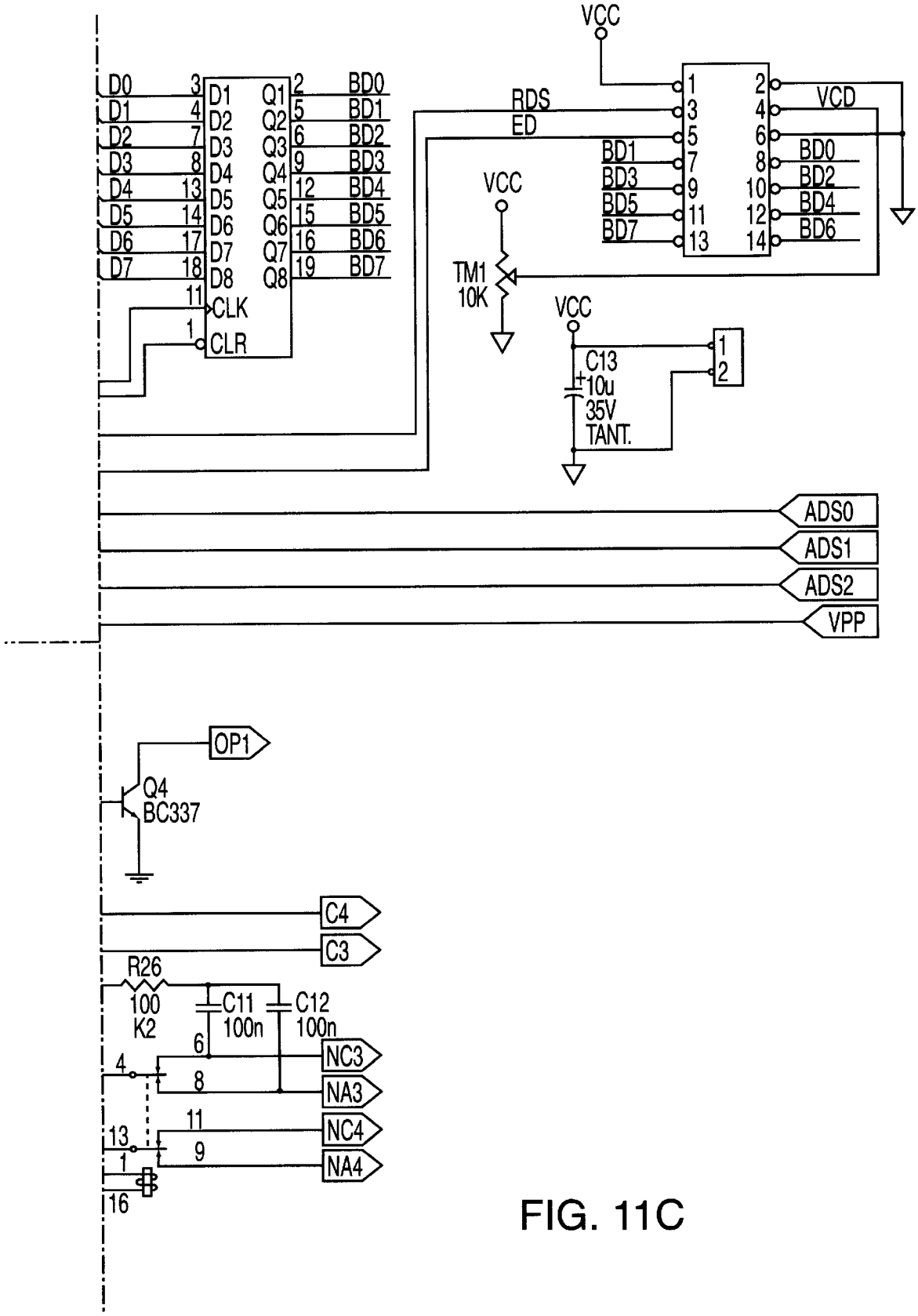
Figure 12B:
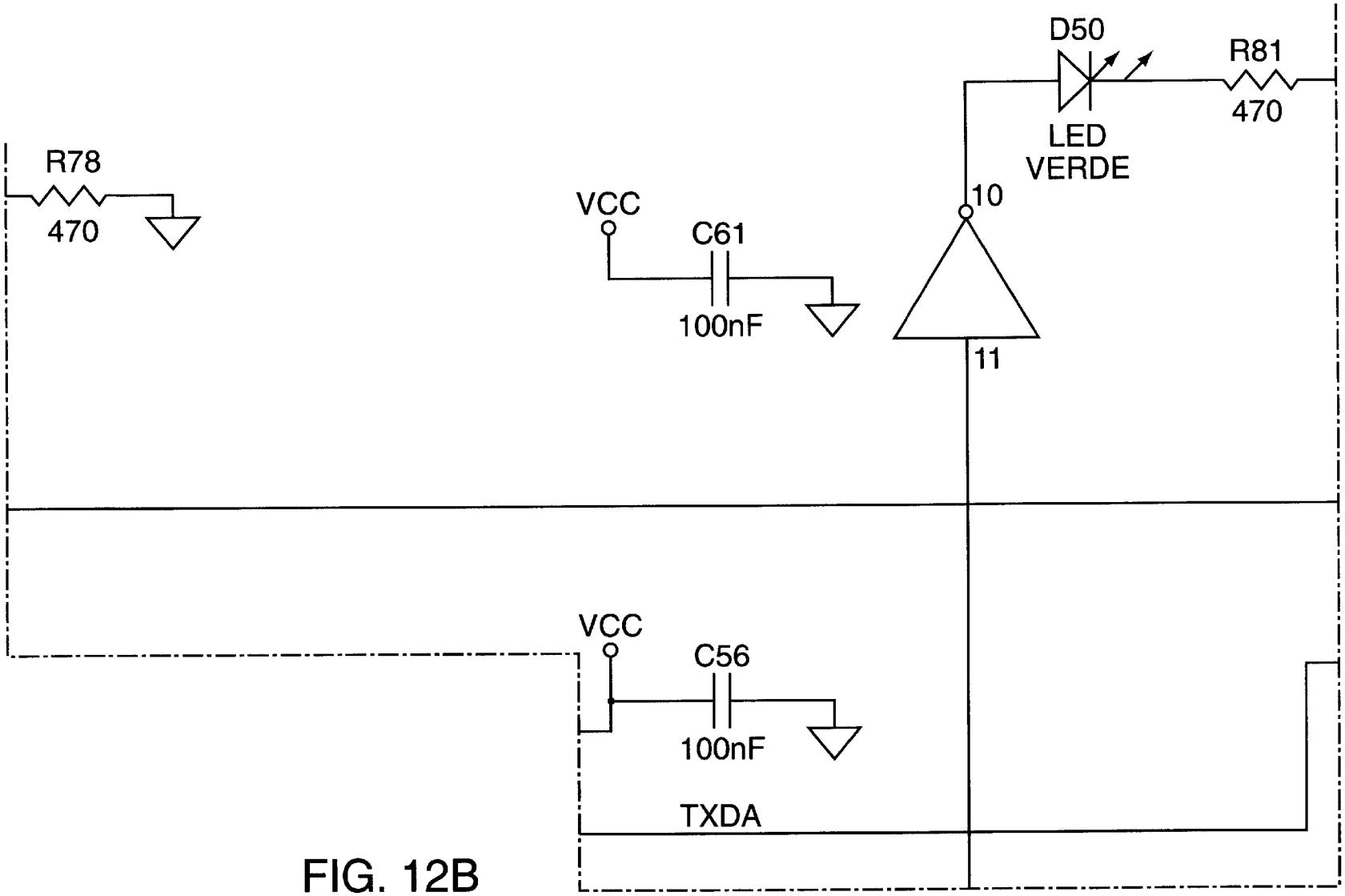
Figure 12C:
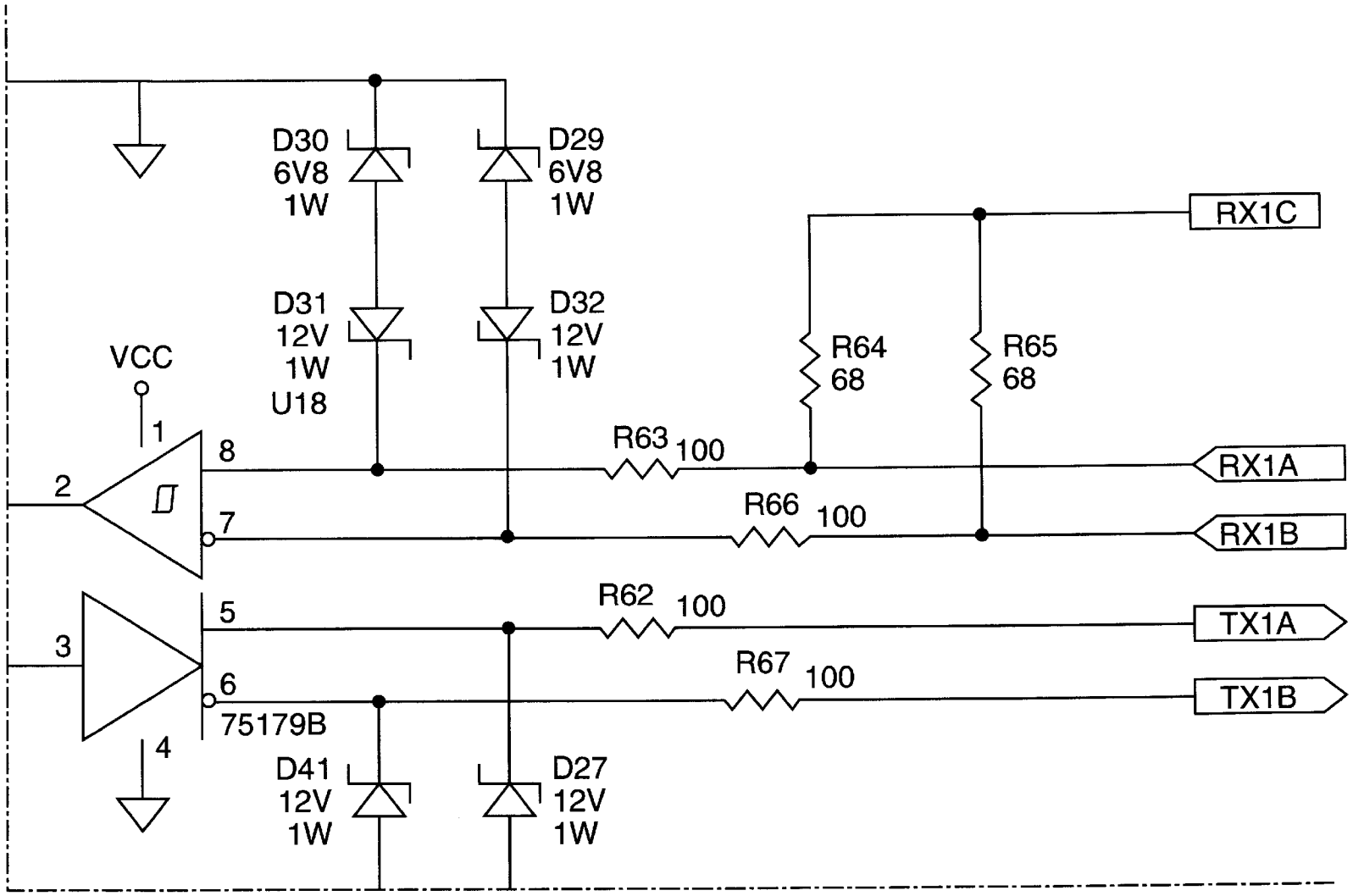
Figure 12D:
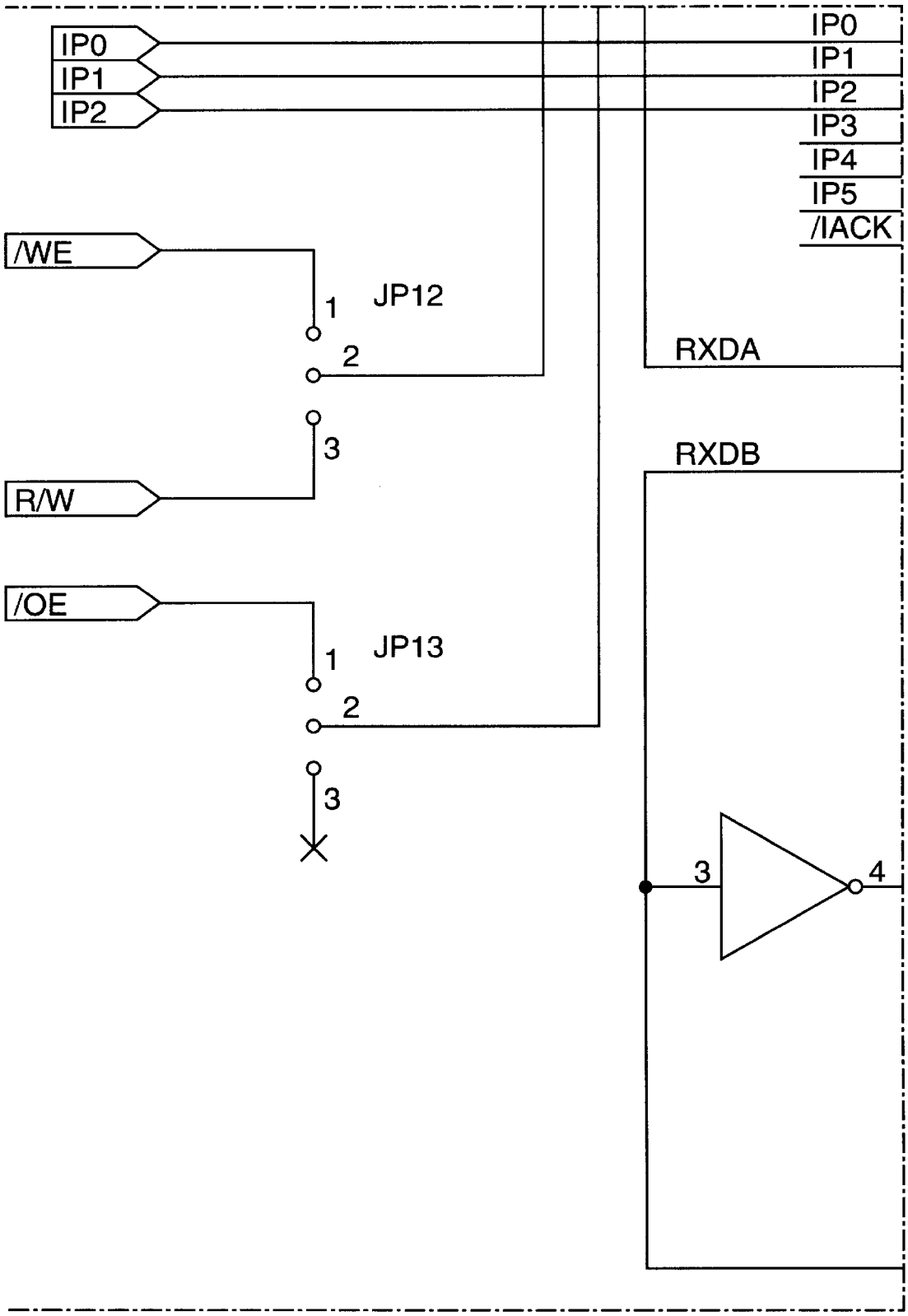
Figure 12E:
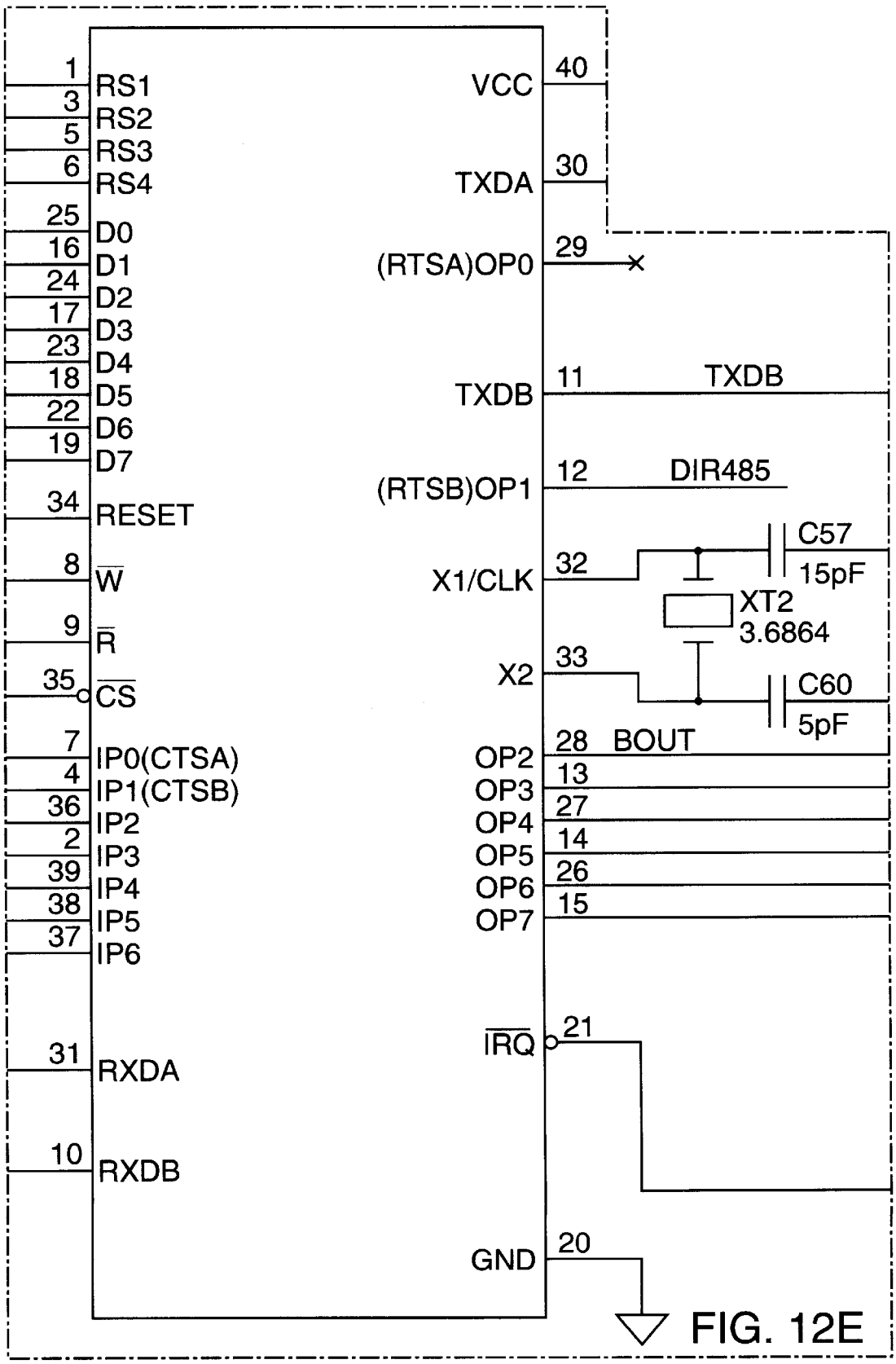
Figure 12F:
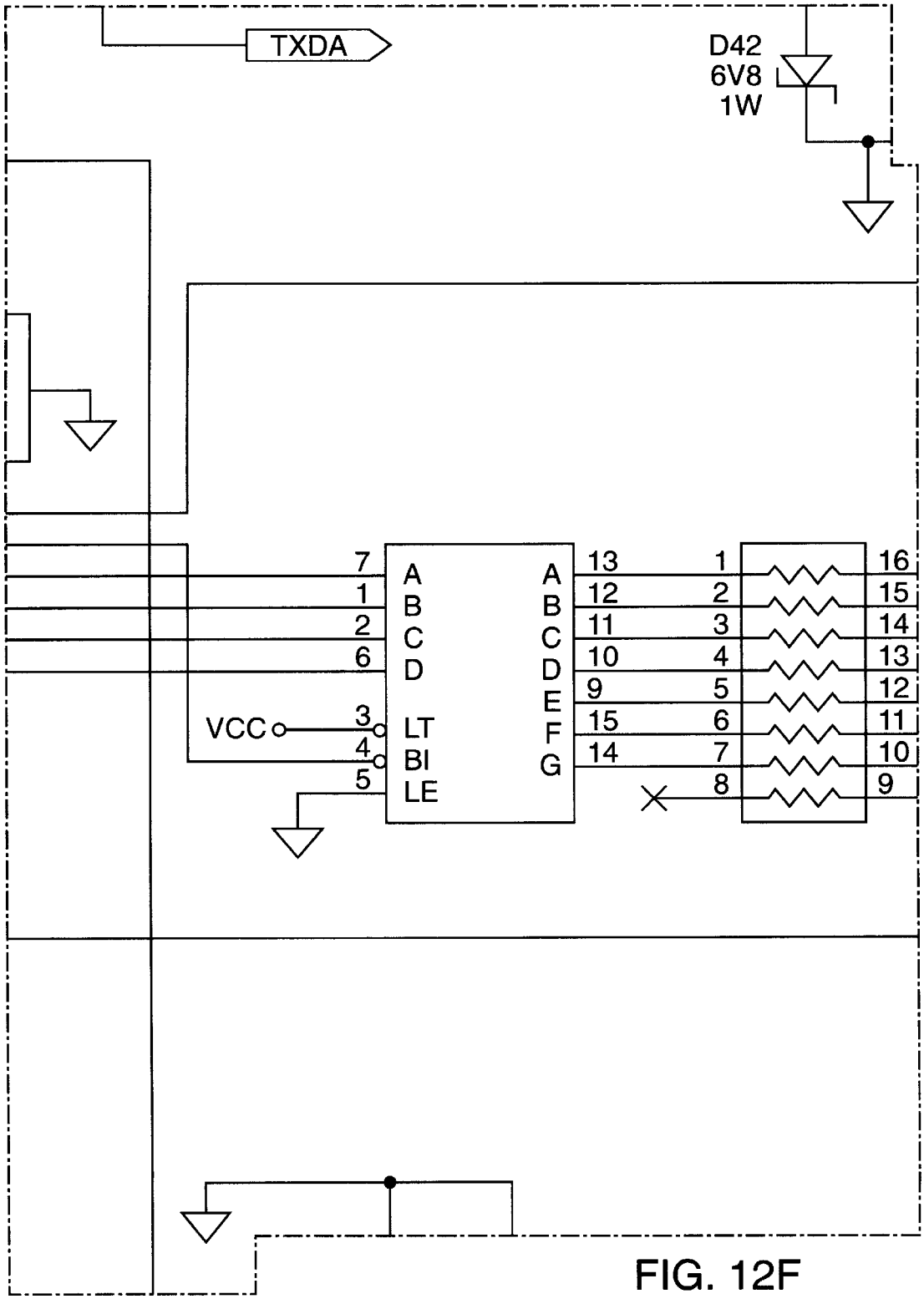
Figure 12G:
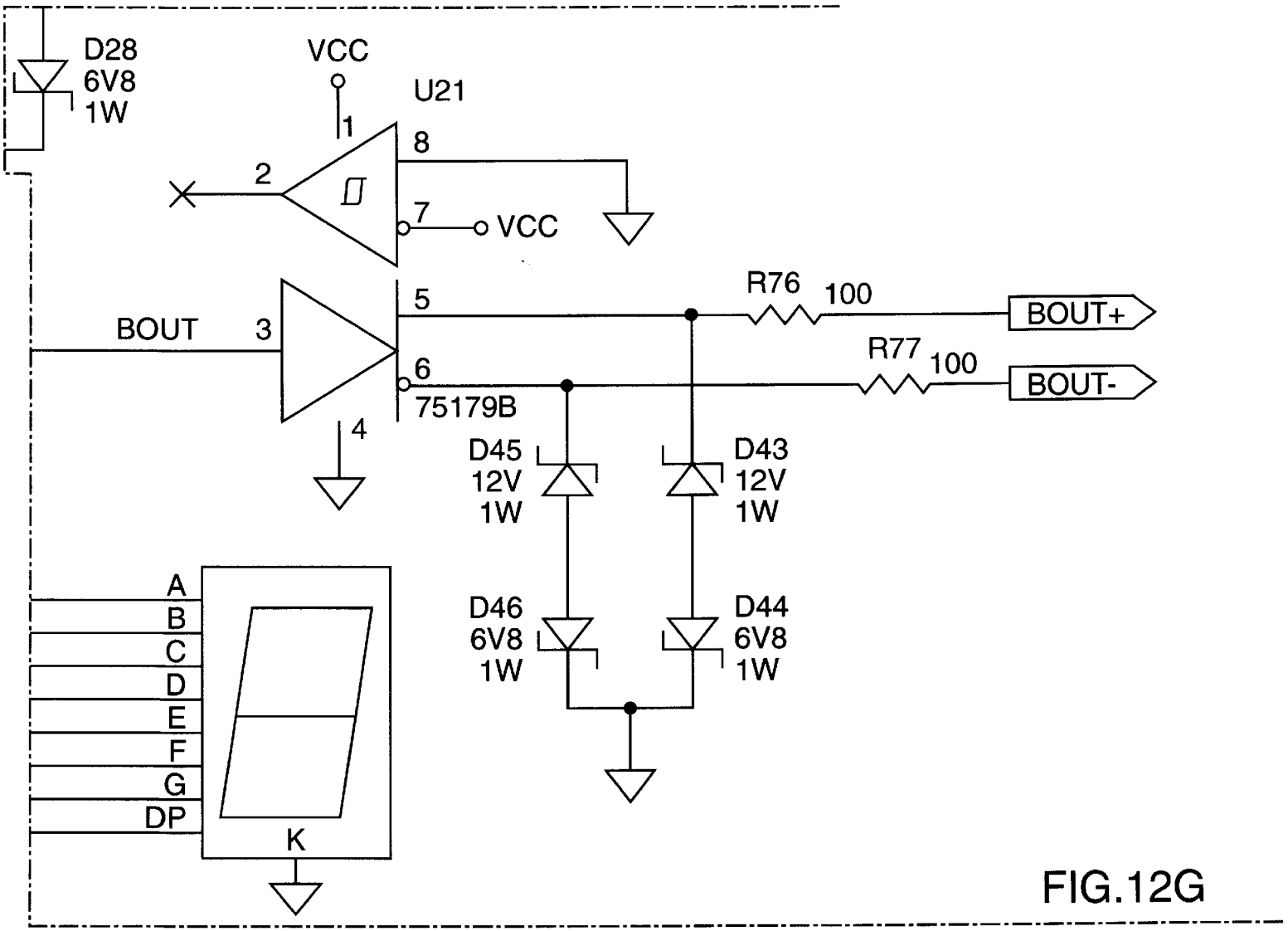
Figure 12H:
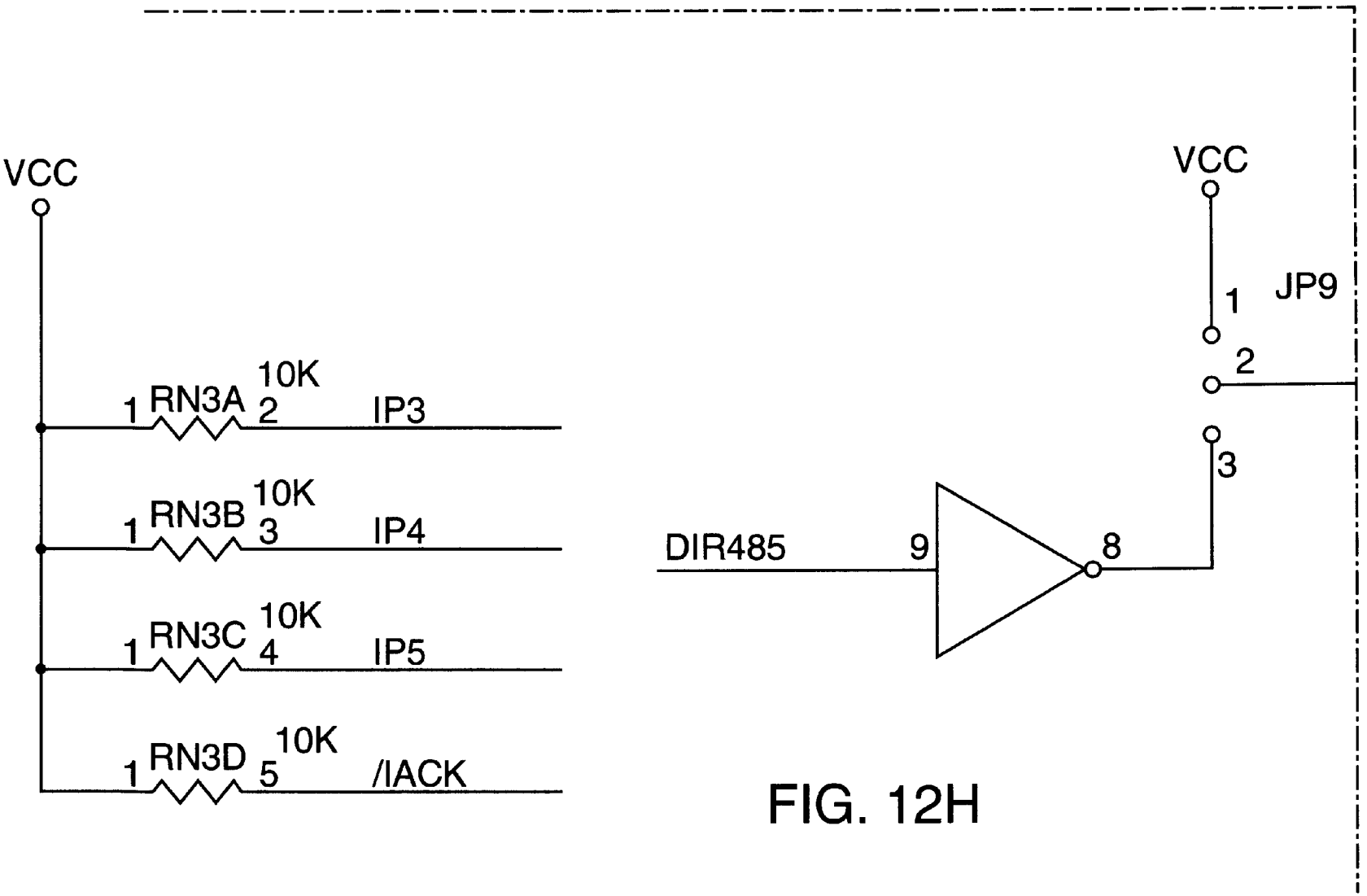
Figure 12I:
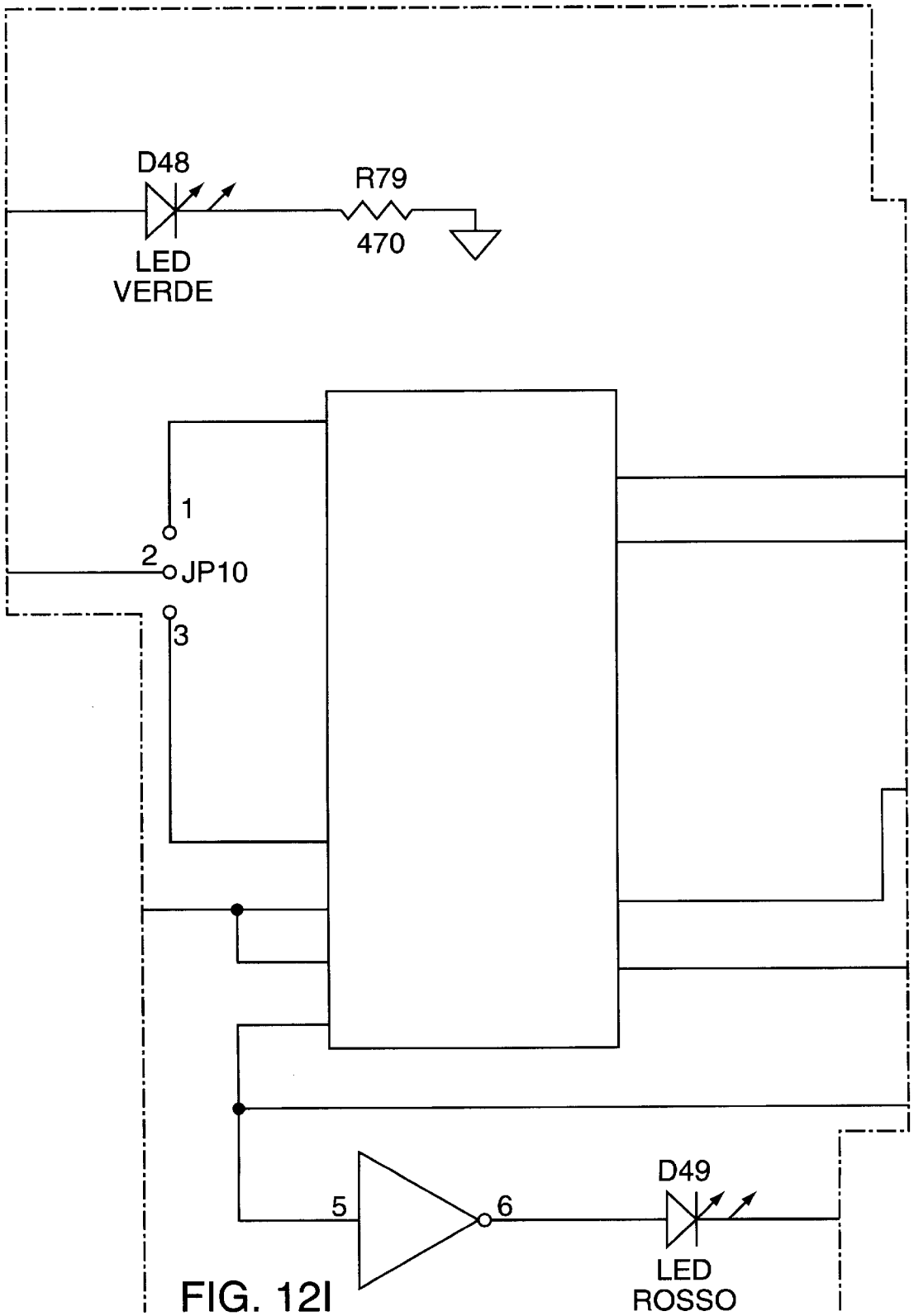
Figure 12J:
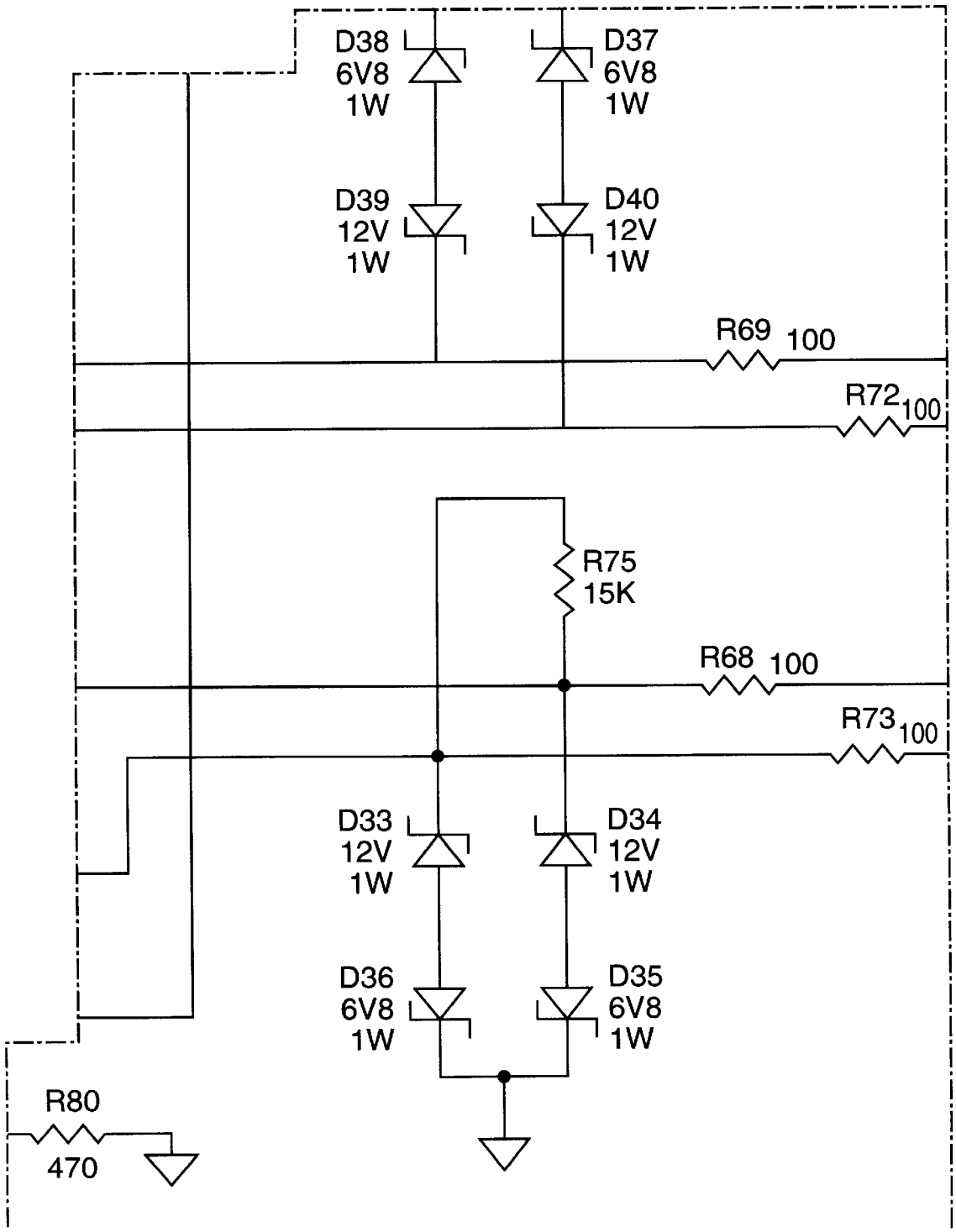
Figure 12K:
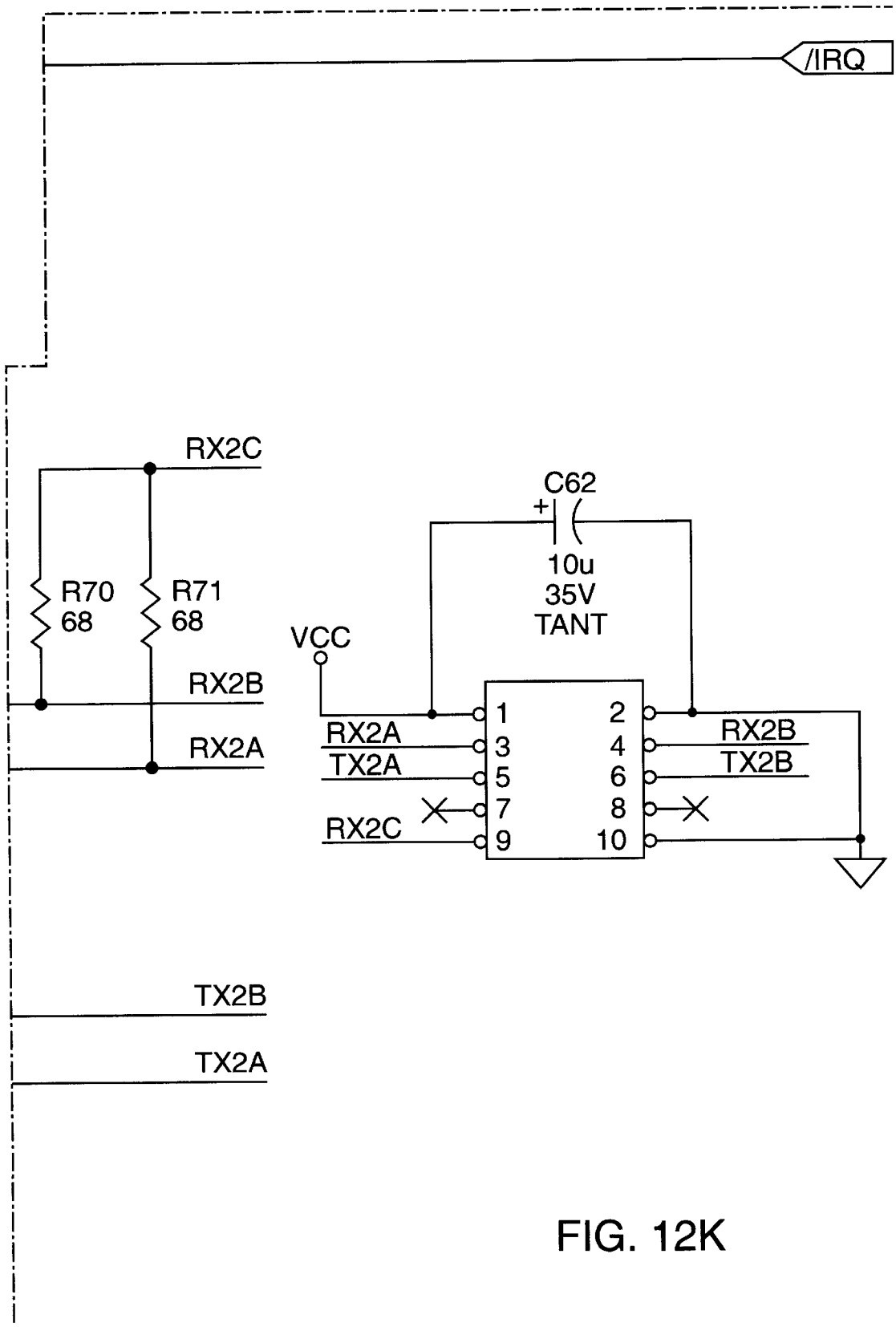
Figure 13B:
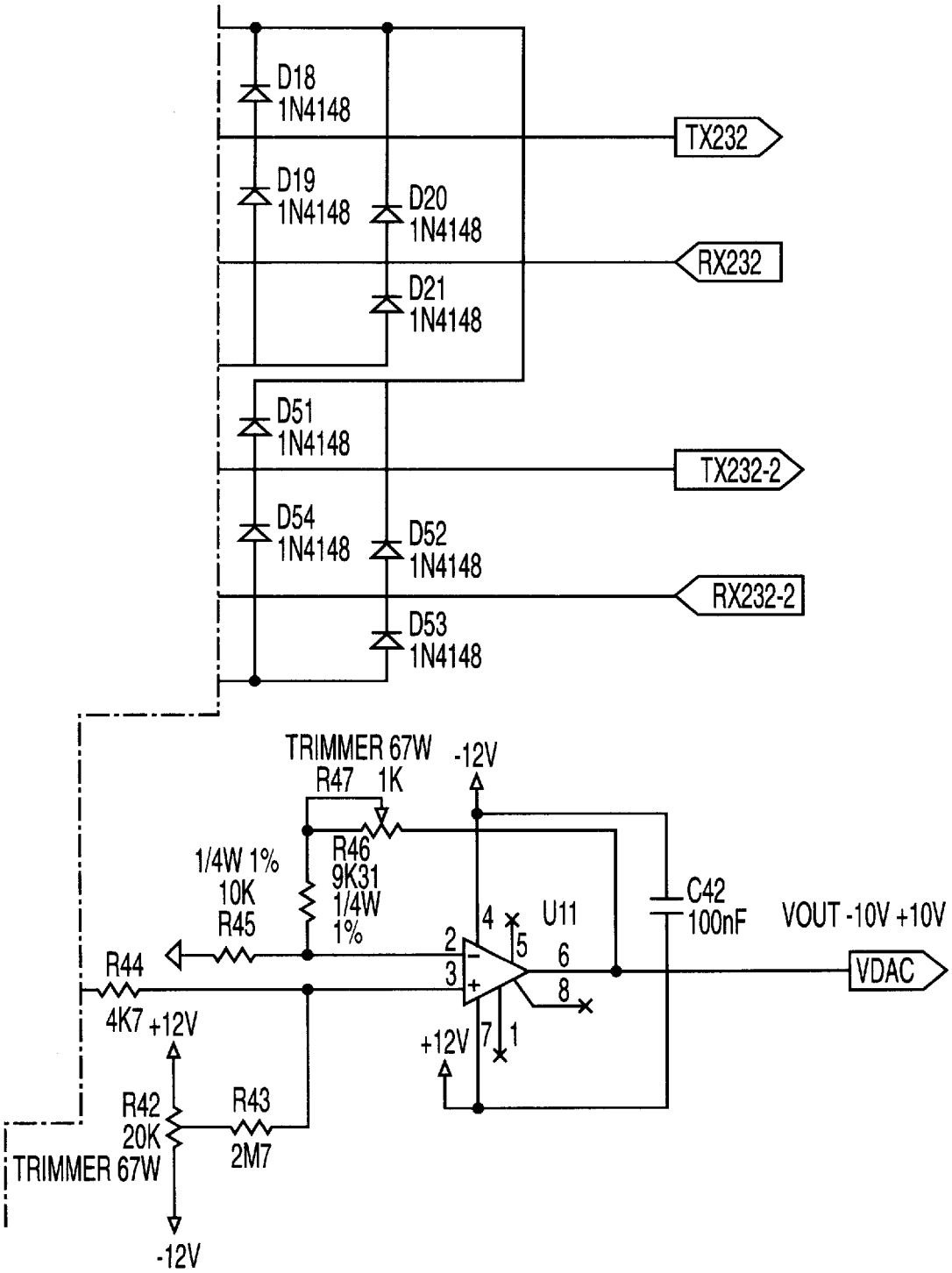
Figure 14A:
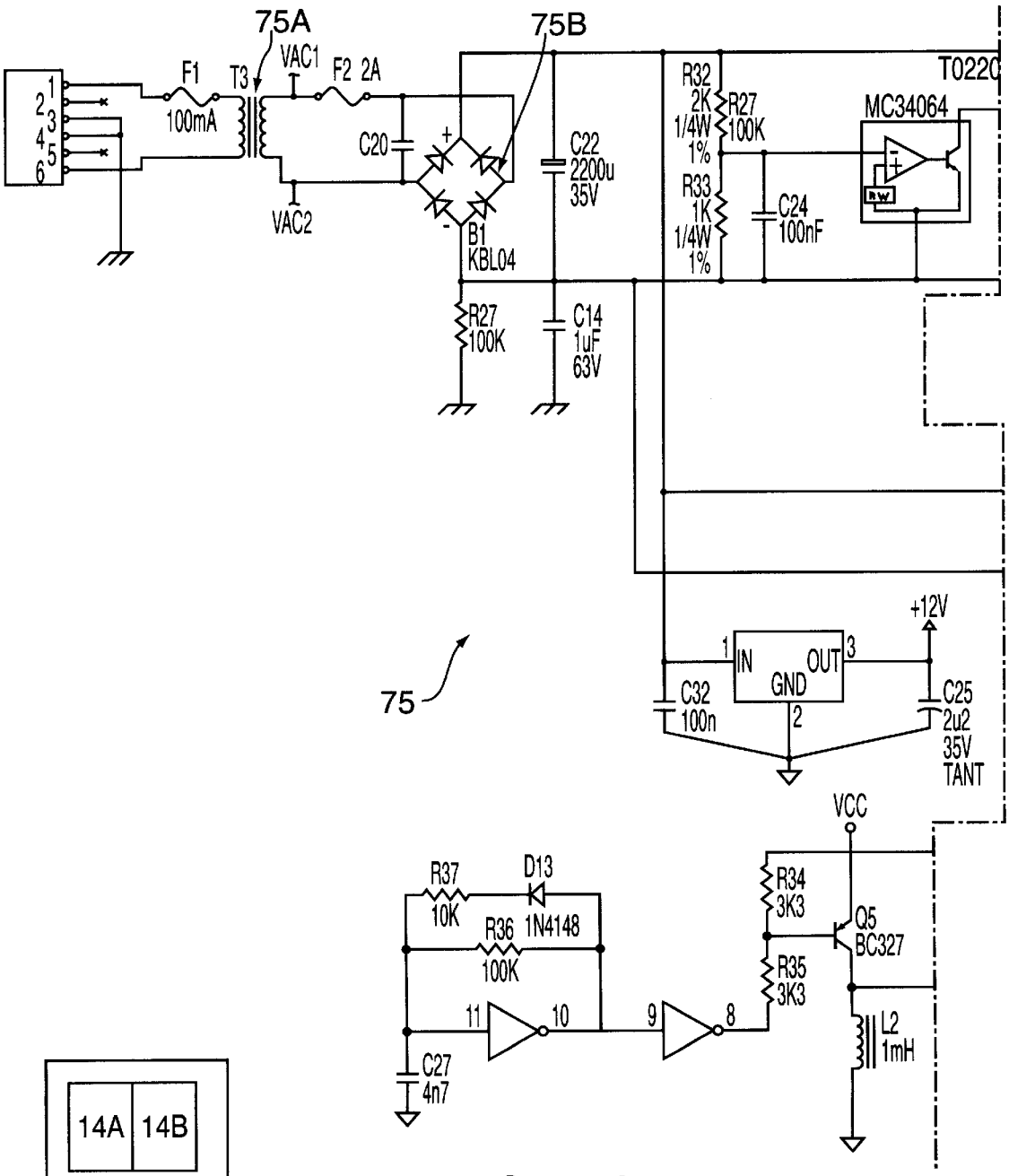
Figure 14:
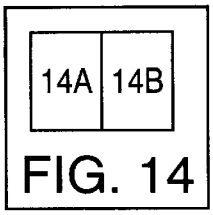
Figure 14B:
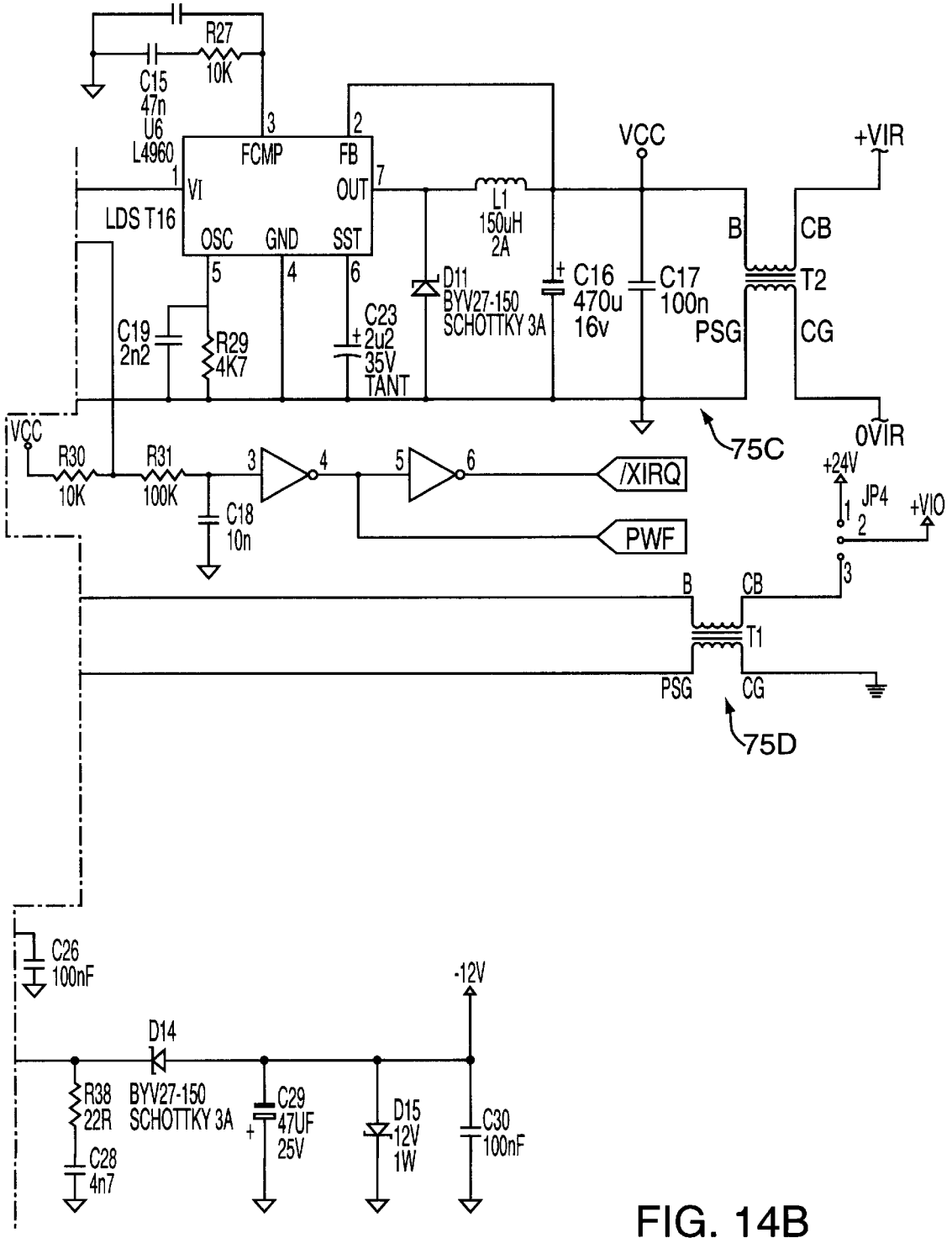
Figure 15:
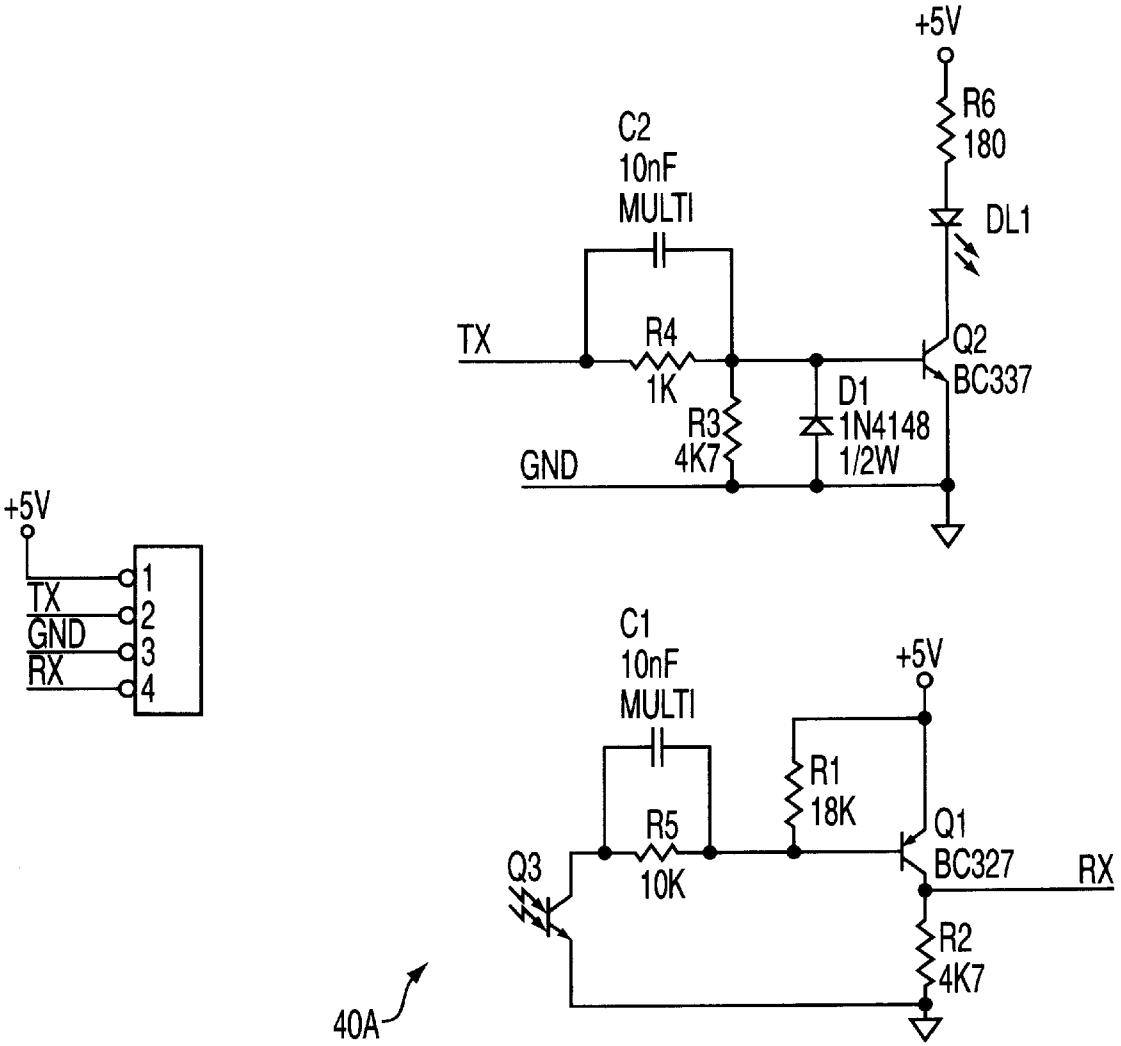
FIG. 15 shows a circuit diagram relative to a second electronic card used for automatically controlling a tensioning unit according to the present invention.

With particular reference to FIGS. 2 and 6, the reference numeral 60 schematically indicates a fixed electromechanical control cubicle for the tensioning unit 10, and 310 indicates overall a rotary mechanical support on which the tensioning unit 10 is mounted.

The electromechanical cubicle 60, which can be installed in a position relatively distant from the tensioning unit 10 or be attached to the tensioning unit 10 (as shown in FIG. 2), comprises a control panel 29 on which the user can manually set the operating parameters or load and store applicational programs relative to the machine operation, a logic card 51 and an electronic card 50, operating as a control terminal for setting the operating parameters.

By means of a serial line 54 the card 50 is connected to a second electronic card 50A identical to the first and mounted on the rotary mechanical support 310 of the tensioning unit 10. Via communication buses 53 the card 50A receives input logic signals relating to the position of the slider C and to the speed of the take-up roller 22 and of the induction motor 25.

The motor 25 is operated by a driver device 28 such as a static frequency converter (or inverter), the electronic card 50A controlling the driver device 28 by a direct access logic command 53A.

Alternatively, instead of the induction motor 25 a traditional motor with internal insulation can be used, attached to a known driver device of brushless type.

The card 50A, mounted on the rotary support 310, directly controls the inverter 28 driving the drawing induction motor 25, in response to a feedback signal originating from the linear position transducer P, which is rigid with the tensioning spring 30 for the yarn-formed fabric F.

An infrared optical coupling system indicated overall by the reference number 40 is provided on a second electronic card 40A, its purpose being to provide communication between the fixed unit 60 and the rotary support 310 via the serial line 54.

In a particular embodiment of the present invention, the electromechanical cubicle 60 is attached to the tensioning unit 10 below the support and rotation rollers 220 for the fabric F and to a baseplate 32.

Figure 5:
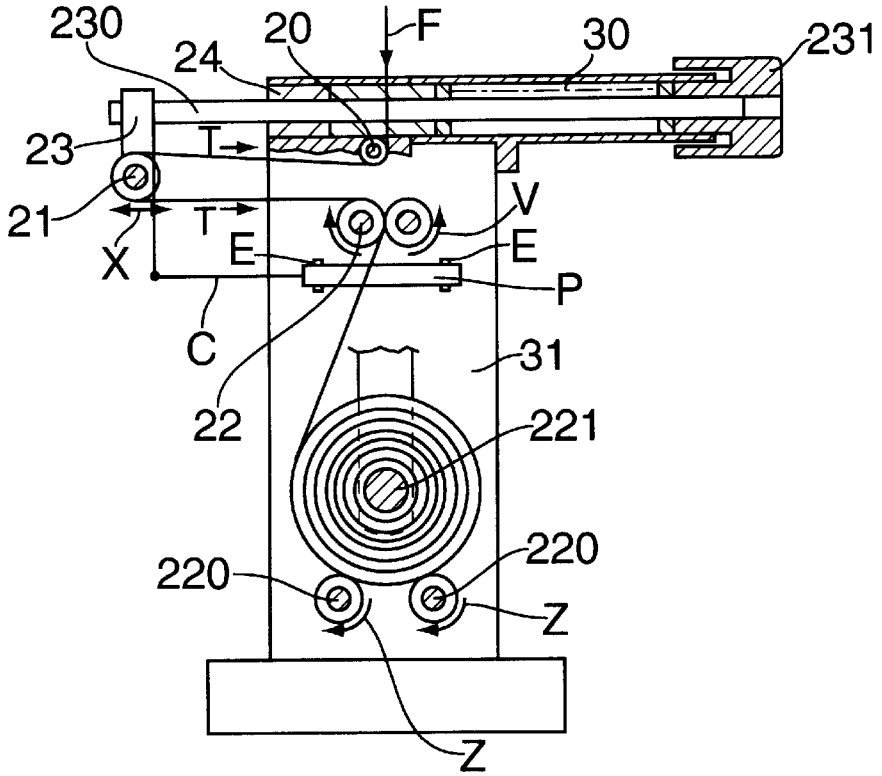
FIG. 5 is a schematic partial cross-section through the tensioning unit according to the invention, provided to show the operating principle of the automatic tensioning system for the yarn-formed fabrics.

With particular reference to FIG. 5, the letter E indicates the ends to which the potentiometer P is fixed, the arrows T indicate the direction and sense of the yarn tension vector in the positions immediately upstream and downstream of the tensioning roller 21, the arrows V indicate the directions of rotation of the take-up rollers 22, the arrows Z indicate the directions of rotation of the support and rotation rollers 220 for the fabric F, and X indicates the direction of shift of the tensioning roller 21 in response to the signal originating from the potentiometer P. With particular reference to FIGS. 7–14, the reference numeral 71 indicates an electronic central data processing unit complete with interface 71A on the system control panel 29, an electronic control system 71B for the control panel keyboard, a memory block 71C for data storage and a reset circuit 71D.

The reference numeral 72 indicates a data storage block formed with traditional electronic circuits 72A, 72B and a logic block 72C for determining the feeding commands to the applicational data processing program, 73 and 74 indicate two electronic control circuits for digital/analog conversion, analog/digital conversion and display of data relative to the position of the spring 30 and the speed of the motor 25, and 75 indicates an electronic power circuit for the control system of the invention.

The power circuit 75 is composed of an inlet transformer 75A (220V/17V), a rectifier bridge 75B for the inlet voltage, and a series of filter circuits 75C, 75D.

Finally, 76 and 77 indicate two electronic blocks for handling and processing the input and output data of the control system of the present invention respectively.

Specifically, the drawing state is analyzed both during the insertion of the yarn-formed fabric F into the tensioning unit 10 and with the machine at rest, to then enable the motor 25 and the take-up roller 22 to rotate at a speed controllable by a torque command.

The purpose of the automatic control system is to maintain the tension T of the fabric F constant for any travel speed of the fabric F about the rollers 20, 21 and 22. For this purpose a sensor (not shown) is used directly connected to the linear position transducer (potentiometer) P.

The transducer P acquires and transmits signals corresponding to operating voltages or currents relative to the positions of the fabric F both during the operation of the tensioning unit 10 and with the machine at rest, and corresponding to the relative position of a point pertaining to the spring 30, which deforms in relation to the tension T of the fabric F acting on the tensioning roller 21.

The signal from the position transducer P is conveyed and transmitted to a central electronic processing unit 71 on the electronic card 50 which is positioned in a fixed electromechanical cubicle 60 external to the tensioning unit 10, and which processes it to then, on the basis of the received information and by means of a dedicated applicational program, control the operation of the inverter 28 and motor 25.

In this respect, at each variation in the speed of the fabric F about the roller 21, the spring 30 reacts to maintain the fabric F under tension and provide information to the applicational program regarding its deformation, on the basis of the variation in the position of the slider C of the linear position transducer or potentiometer P.

The tension of the fabric F is controlled by the driver device 28, which increases or decreases the torque (and hence the rotational speed) of the induction motor 25 (which is rigid with one of the take-up rollers 22), on the basis of the data received relative to the deformation of the spring 30 and to the relative position of the slider C, in such a manner as to maintain the tension T constant.

The data relative to the position of the spring 30 is transmitted partly via a serial connection 54 between the central electronic processing unit 71 and a second electronic processing unit 50A positioned on the tensioning unit 10, via an electronic infrared optical coupling card 40A.

The electronic processing unit 50A controls the inverter 28 by a direct access command 53A, on the basis of a feedback signal 53 representing the speed of the motor 25 originating from the inverter 28, and on the basis of a control signal originating from the potentiometer P.

Power and energy are transmitted to the motor 25 via a three-way collector, indicated by 44 in FIG. 1 and with rotating brushes 45, which is housed in a casing 46.

The parameters relative to the speeds of the entry roller 20, the tensioning roller 21 and the take-up rollers 22, the sensor, the linear position transducer P, the rotational speed of the motor 25 and all operating values settable on the inverter 28 can be programmed both automatically and manually on a control panel 29 which is positioned in the fixed electromechanical cubicle 60 external to the tensioning unit 10, an disconnected to the central processing unit 71 of the electronic card 50.

By way of non-limiting example, a practical embodiment for this application could use a special induction motor 25 with high natural dissipation, having a 90 mm flange, 5.5 mm holes and a cable of length 60 cm.

Finally, an inverter 28 of ultra-flat type is installed, able to provide high current intensity output values (up to a maximum of 7 A) and of dissipatable power (the inverter 28 is designed for 0.37 kW but in the enlarged version can reach 0.75 kW). In this manner the inverter 28 is able to fully exploit the characteristics of the natural dissipation induction motor 25.

The output frequency of the inverter 28 is programmable within a range of 0 to 1300 Hz (end values included).

The characteristics of the tensioning unit with automatic tension control for yarn-formed fabrics according to the present invention are clear from the aforegoing description, as are its advantages. In particular, these regard the following aspects:

ability to set the drawing parameters or to store and load applicational programs and automatic routines for yarn tensioning;

direct and simultaneous operation of the driver device controlling the drawing motor in response to a feedback signal relative to the tensioning of the yarn-formed fabric;

ability to maintain the tension of the yarn-formed fabrics constant at all speeds of the tensioning unit;

ability to continuously monitor the yarn tension;

greater yarn productivity and quality than the known art, with respect to the subsequent operations to be effected.

It is apparent that numerous modifications can be made to the tensioning unit with automatic yarn tension control according to the present invention, without thereby leaving the novel principles of the inventive idea, it being further apparent that in the practical implementation of the invention the materials, forms and dimensions of the illustrated details can be chosen according to requirements and can be replaced by others technically equivalent.

The Italian priority application No. MI97A 000962 is herein incorporated by reference.

I claim:

1. A tensioning unit (10) with automatic control of the tension (T) of yarn-formed fabrics (F), comprising an external support structure (31), a baseplate (32), a rotary mechanical support (310) on which a tensioning unit (10) is mounted, an operating key (26), at least one first roller (20) for the entry of the yarn-formed fabric (F) into the tensioning unit (10), at least one tensioning second roller (21) fixed to said support structure (31) by a plurality of supports (23) and rigid with a shaft (230) slidable on bearings (24), and for take-up of the fabric (F) at least one third roller (22) rigid with the shaft of a yarn drawing motor (25) controlled by a driver device (28), rotary motion being transmitted between said third roller (22), rollers (220) for supporting and rotating said fabric (F) and a fabric winding roller (221) by a belt or chain drive (27), characterized in that to said tensioning second roller (21) there is connected an elastic element (30) which is fixed to the support structure (31) of the tensioning unit (10) and on which there is rigidly mounted a slider (C) of a sensor device (P), said device (P) being connected to at least one first electronic card (50A) the purpose of which is to control, by means of an electronic application processing program, the operation of said driver device (28) on the basis of a signal originating from said sensor device (P) and of a feedback signal originating from said driver device (28), in such a manner that the yarn tension (T) remains constant at each variation in the speed of the fabric (F) within the tensioning unit (10).

2. A tensioning unit (10) as claimed in claim 1, characterised in that said first electronic card (50A) dialogues with said driver device (28) by means of a direct access logic control command (53A).

3. A tensioning unit (10) as claimed in claim 1, characterised in that said first electronic card (50A) is connected to at least one second electronic card (50), identical to the first (50A), by an infrared optical coupling system (40) formed by at least one third electronic card (40A).

4. A tensioning unit (10) as claimed in claim 3, characterised in that said second electronic card (50) is mounted in a fixed structure (60) external to the tensioning unit (10), and is connected to a control panel (29) by which the input parameters of the tensioning unit (10) can be set or applicational operating programs for the unit (10) can be stored and loaded, and to a logic card (51) containing the operating parameters for the tensioning unit (10).

5. A tensioning unit (10) as claimed in claim 3, characterised in that said third electronic card (40A) provides communication, via a serial line (54), between an electromechanical cubicle (60) and said rotary mechanical support (310), on which the tensioning unit (10) is mounted.

6. A tensioning unit (10) as claimed in claim 1, characterised in that said signals originating from said sensor device and/or transducer (P) and from said driver device (28) are logic signals, which travel along bus communication lines (53).

7. A tensioning unit (10) as claimed in claim 1, characterised in that said elastic element (30) is a spring, the deformation of which provides information relative to the tension (T) of the yarn-formed fabric (F) in correspondence with said tensioning second roller (21).

8. A tensioning unit (10) as claimed in claim 1, characterized in that said motor (25) is an unventilated induction motor with natural dissipation, and said driver device (28) is a static frequency converter or inverter which can provide as output a maximum deliverable current of 7 A and a maximum dissipatable power of 0.75 kW and is adjustable within a frequency range of between 0 and 1300 Hz.

9. A tensioning unit (10) as claimed in claim 8, characterised in that power and energy are transmitted to the induction motor (25) via a three-way collector (44) with rotating brushes (45), which is housed in a casing (46).

10. A tensioning unit (10) as claimed in claim 1, characterised in that said first electronic card (50A) comprises a central electronic data processing unit (71), an electronic control system (71B) for a data insertion terminal, at least one first data memory (71C) and storage element, an electronic reset circuit (71D), at least one second data memory (72, 72A, 72B) and storage element, a logic element (72C) for determining and feeding commands to an applicational data processing program, a plurality of electronic circuits (73, 74) for digital/analog conversion, analog/digital conversion and data display, at least one electronic powering circuit (75) and a plurality of electronic control means (76, 77) for processing the data relative to the drawing state of the yarn-formed fabrics (F) within the tensioning unit (10) and for enabling said motor (25) to rotate at a controllable angular velocity.

11. A tensioning unit (10) as claimed in claim 1, characterized in that said motor (25) is a motor with internal insulation, said driver device (28) being brushless type.

* * * * *